US010900161B2

(12) United States Patent
Park et al.

(10) Patent No.: US 10,900,161 B2
(45) Date of Patent: Jan. 26, 2021

(54) WASHING MACHINE AND CONTROL METHOD THEREOF

(71) Applicant: SAMSUNG ELECTRONICS CO., LTD., Suwon-si (KR)

(72) Inventors: Jung Ha Park, Seongnam-si (KR); Su Jin Seong, Hwaseong-si (KR); Joo Yeon Park, Seoul (KR); Bo-Kyung Lee, Suwon-si (KR); Sang Yeon Pyo, Yongin-si (KR); Ja Yeon Seo, Suwon-si (KR); Woo Kyung Jung, Suwon-si (KR); Jeong Su Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/115,773

(22) Filed: Aug. 29, 2018

(65) Prior Publication Data

US 2019/0062977 A1 Feb. 28, 2019

(30) Foreign Application Priority Data

Aug. 29, 2017 (KR) ..... 10-2017-0109282
Feb. 13, 2018 (KR) ..... 10-2018-0017936

(51) Int. Cl.
*D06F 33/00* (2020.01)
*D06F 23/02* (2006.01)
(Continued)

(52) U.S. Cl.
CPC ..... *D06F 33/00* (2013.01); *D06F 23/02* (2013.01); *D06F 25/00* (2013.01); *D06F 37/10* (2013.01);
(Continued)

(58) Field of Classification Search
CPC ..... D06F 33/02
See application file for complete search history.

(56) References Cited

U.S. PATENT DOCUMENTS

2006/0156766 A1 7/2006 Ioku
2008/0216250 A1 9/2008 Lee et al.
(Continued)

FOREIGN PATENT DOCUMENTS

CN 102733151 10/2012
EP 1 645 674 A1 4/2006
(Continued)

OTHER PUBLICATIONS

International Search Report dated Dec. 19, 2018, in International Patent Application No. PCT/KR2018/009987.
(Continued)

*Primary Examiner* — Jason Y Ko
(74) *Attorney, Agent, or Firm* — Staas & Halsey LLP

(57) ABSTRACT

A washing machine including a door provided to open and close an inlet, a tub having an opening corresponding to the inlet, a drum rotatably provided inside the tub and in which laundry is accomodatable, a door cleaning nozzle provided to spray washing water toward the door, a pump chamber provided at a lower portion of the tub to store the washing water discharged from the tub, a drain pump provided to pump the washing water stored in the pump chamber and discharge the washing water to the outside, and a controller provided to rotate the drum in order to tumble the laundry, spray washing water through the door cleaning nozzle, operate the drain pump to discharge the washing water stored in the pump chamber, and supply the washing water to a water supply pipe connected to a detergent supply device.

19 Claims, 25 Drawing Sheets

(51) Int. Cl.

| | |
|---|---|
| ***D06F 37/10*** | (2006.01) |
| ***D06F 25/00*** | (2006.01) |
| ***D06F 39/06*** | (2006.01) |
| ***D06F 39/08*** | (2006.01) |
| ***D06F 39/02*** | (2006.01) |
| *D06F 39/14* | (2006.01) |
| *D06F 37/26* | (2006.01) |

(52) U.S. Cl.
CPC ..... *D06F 39/022* (2013.01); *D06F 39/06* (2013.01); *D06F 39/085* (2013.01); *D06F 37/266* (2013.01); *D06F 39/083* (2013.01); *D06F 39/14* (2013.01); *D06F 2204/065* (2013.01)

(56) References Cited

U.S. PATENT DOCUMENTS

2008/0245113 A1 10/2008 Kim
2011/0099727 A1* 5/2011 Kim ..... D06F 35/006 8/137
2013/0145562 A1* 6/2013 Lee ..... D06F 39/088 8/137
2014/0366588 A1 12/2014 Kim et al.
2017/0241060 A1 8/2017 Seong et al.

FOREIGN PATENT DOCUMENTS

| | | |
|---|---|---|
| JP | 2009-34257 | 2/2009 |
| JP | 2017-29678 | 2/2017 |
| KR | 2002-0056605 | 7/2002 |
| KR | 10-1059910 | 8/2011 |
| KR | 10-2014-0028406 | 3/2014 |
| KR | 10-2015-0039630 | 4/2015 |
| WO | WO 2015/161667 A1 | 10/2015 |

OTHER PUBLICATIONS

European Search Report dated Jan. 17, 2019, in European Patent Application No. 18190842.7.

* cited by examiner

WASHING MACHINE AND CONTROL METHOD THEREOF

CROSS-REFERENCE TO RELATED APPLICATION(S)

This application Is based on and claims priority under 35 U.S.C. § 119 to 5 Korean Patent Application Nos. 10-2017-0109282, filed on Aug. 29, 2017, and 10-2018-0017936, filed on Feb. 13, 2018 In the Korean Intellectual Property Office, the disclosures of which are incorporated by reference herein in their entirety.

BACKGROUND

1. Technical Field

The present disclosure relates to a washing machine and a control method thereof including a rotatable drum.

2. Description of the Related Art

Generally, a washing machine refers to a household appliance that washes clothes using electric power. The washing machine includes a drum type washing machine for washing laundry by repeating lifting and dropping of the laundry by rotating a washing tub, and an electric washing machine for washing laundry by using the water current generated by a pulsator when the washing tub is rotated.

Laundry such as clothes and bedclothes is exposed to contaminants such as sweat and keratin from the human body, fungi in the air, bacteria, fine dust, heavy metals, and dust. These contaminants may penetrate deep into the fiber surface or material, causing discoloration and/or damage of clothes or bedclothes, or adversely affecting the wearer's skin and respiratory system.

SUMMARY

It is an aspect of the present disclosure to provide a washing machine and a control method thereof capable of preventing separated contaminants from mixing with laundry again in a main washing process and effectively removing the contaminants present in the laundry by separating the contaminants present in the laundry from the laundry through a waterless process using a mechanical force of a drum and performing the main washing process after washing and discharging the separated contaminants with water.

Additional aspects of the present disclosure will be set forth in part in the description which follows and, in part, will be obvious from the description, or may be learned by practice of the disclosure.

In accordance with one aspect of the present disclosure, there may be provided a washing machine including a main body provided with an inlet into which laundry is put at a front portion thereof, a door provided to open and close the inlet, a tub having an opening corresponding to the inlet and provided inside the main body, a drum rotatably provided inside the tub and accommodating the laundry, a door cleaning nozzle provided to spray washing water toward the door, a pump chamber provided at a lower portion of the tub to store the washing water discharged from the tub, a drain pump provided to pump the washing water stored in the pump chamber and discharge the washing water to the outside, and a controller provided to rotate the drum in order to tumble the laundry, spray washing water through the door cleaning nozzle, operate the drain pump to discharge the washing water stored in the pump chamber, and supply the washing water to a water supply pipe connected to a detergent supply device.

The washing machine may further include a circulation duct provided to introduce air into the drum, a drying duct provided to discharge air into the drum, and a blowing fan provided to form a flow of air between the circulation duct and the drying duct, and the controller may operate the blowing fan to supply air into the drum while the drum rotates.

The washing machine may further include a heater provided to heat the air discharged into the drum, and the controller may control the heater to supply hot air to the inside of the drum when the blowing fan operates.

The washing machine may further include a diaphragm provided to connect the inlet of the main body and the opening of the tub, and the controller, in order to clean the diaphragm, may rotate the drum at a preset speed and sprays washing water through the door cleaning nozzle for a preset time at a preset point.

The washing machine may further include a cleaning reinforcing nozzle provided on the diaphragm to spray washing water toward the inside of the drum, and the controller may spray the washing water through the cleaning reinforcing nozzle in order to clean the diaphragm.

The washing machine may further include a diaphragm cleaning nozzle provided at a position corresponding to a rotation direction of the drum on a buffer portion, which is a region where the diaphragm is bent, to spray washing water to the diaphragm, and the controller may spray the washing water through the diaphragm cleaning nozzle in the rotating direction of the drum when the washing water is sprayed through the door cleaning nozzle.

The controller may supply washing water to the circulation duct before supplying the washing water to the water supply pipe connected to the detergent supply device.

The washing machine may further include a water supply pipe provided to be connected to a rear upper side of the tub, and the controller may supply washing water to the water supply pipe connected to the rear upper side of the tub to supply the washing water to a rear surface of the tub before supplying the washing water to the water supply pipe connected to the detergent supply device.

The controller may supply washing water to the pump chamber to push the washing water stored in the pump chamber before supplying the washing water to the water supply pipe connected to the detergent supply device.

The controller may set a rotational speed (RPM) and an operation rate of the drum based on the weight of the loaded laundry.

In accordance with another aspect of the present disclosure, there may be provided a control method of a washing machine which includes a main body provided with an inlet into which laundry is put at a front portion thereof, a door provided to open and close the inlet, a tub having an opening corresponding to the inlet and provided inside the main body, a drum rotatably provided inside the tub and accommodating the laundry, and a door cleaning nozzle provided to spray washing water toward the door, the control method including rotating the drum in order to tumble the laundry, spraying washing water through the door cleaning nozzle, operating a drain pump to discharge the washing water stored in a pump chamber, and supplying the washing water to a water supply pipe connected to a detergent supply device.

The control method may further include operating, during the rotation of the drum, a blowing fan, which is provided to form a flow of air between a circulation duct for introducing air into the drum and a drying duct for discharging air into the drum, to supply air into the drum.

The control method may further include controlling, during the rotation of the drum, a heater, which is provided to heat the air discharged into the drum, to supply hot air to the inside of the drum when the blowing fan operates.

The spraying of the washing water through the door cleaning nozzle may include rotating the drum at a preset speed, and spraying the washing water through the door cleaning nozzle for a preset time at a preset point to clean a diaphragm provided to connect the inlet of the main body and the opening of the tub.

The control method may further include supplying washing water to the circulation duct before supplying the washing water to a water supply pipe connected to a detergent supply device.

In accordance with another aspect of the present disclosure, there may be provided a washing machine including a tub provided inside a main body, a drum rotatably provided inside the tub and accommodating laundry, at least one nozzle provided to spray washing water to the inside of the drum, a pump chamber provided at a lower portion of the tub to store the washing water discharged from the tub, a drain pump provided to pump the washing water stored in the pump chamber and discharge the washing water to the outside, and a controller provided to rotate the drum to separate contaminants from the laundry, spray washing water to the inside of the drum through the at least one nozzle, rotate the drum in one direction to discharge the washing water contained in the laundry into a space between the drum and the tub, operate the drain pump to discharge the washing water, and supply the washing water to a water supply pipe connected to a detergent supply device in order to perform a main washing process.

The washing machine may further include a dust sensor provided to sense an amount of dust, and the controller may set at least one drum rotation factor of a rotational speed of the drum, an operation rate of the drum, and a rotational time of the drum based on the amount of dust sensed by the dust sensor.

The controller, when rotating the drum in one direction, may rotate the drum at a higher speed than when the drum is rotated to separate contaminants from the laundry.

In accordance with another aspect of the present disclosure, there may be provided a control method of a washing machine which includes a tub, a drum rotatably provided inside the tub and accommodating laundry, at least one nozzle provided to spray washing water to the inside of the drum, and a drain pump provided to pump the washing water stored in the tub, the control method including rotating the drum to separate contaminants from the laundry, spraying washing water to the inside of the drum through the at least one nozzle, rotating the drum in one direction to discharge the washing water contained in the laundry into a space between the drum and the tub, operate the drain pump to discharge the washing water, and supplying the washing water to a water supply pipe connected to a detergent supply device in order to perform a main washing process.

The control method may further include operating, when spraying washing water through the at least one nozzle, the drain pump to discharge the washing water if the water level of the tub reaches a reference value.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
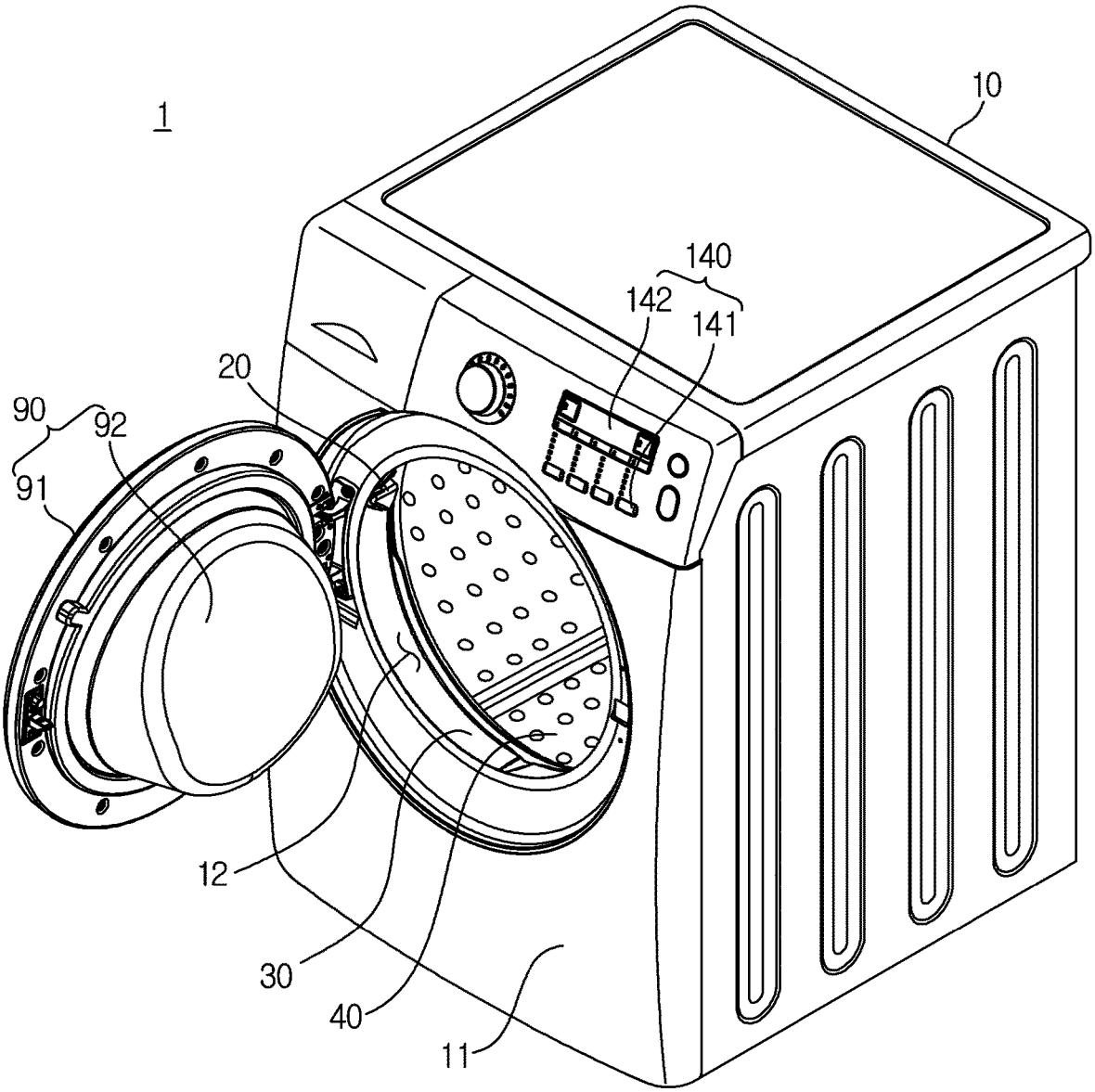
FIG. 1 is an external view of a washing machine according to an embodiment of the present disclosure.

Hereinafter, embodiments of a washing machine and a control method thereof will be described in detail with reference to the accompanying drawings.

The embodiments described herein and the configurations shown in the drawings are only examples of preferred embodiments of the present disclosure, and various modifications may be made at the time of filing of the present disclosure to replace the embodiments and drawings of the present specification.

The terms used herein are for the purpose of describing the embodiments and are not intended to limit the disclosure.

For example, the singular expressions herein may include plural expressions, unless the context clearly dictates otherwise.

Also, the terms "comprises" or "has" are intended to indicate that there are features, numbers, steps, operations, elements, parts, or combinations thereof described in the specification, and do not exclude the presence or addition of one or more other features, numbers, steps, operations, elements, parts, or combinations thereof.

In addition, terms such as "~unit," "~part," "~block," "~member," "~module," and the like may denote a unit for processing at least one function or operation. For example, the terms may refer to at least one piece of hardware such as a field-programmable gate array (FPGA)/an application specific integrated circuit (ASIC), at least one software application stored in a memory, or at least one process processed by a processor.

Figure 2:
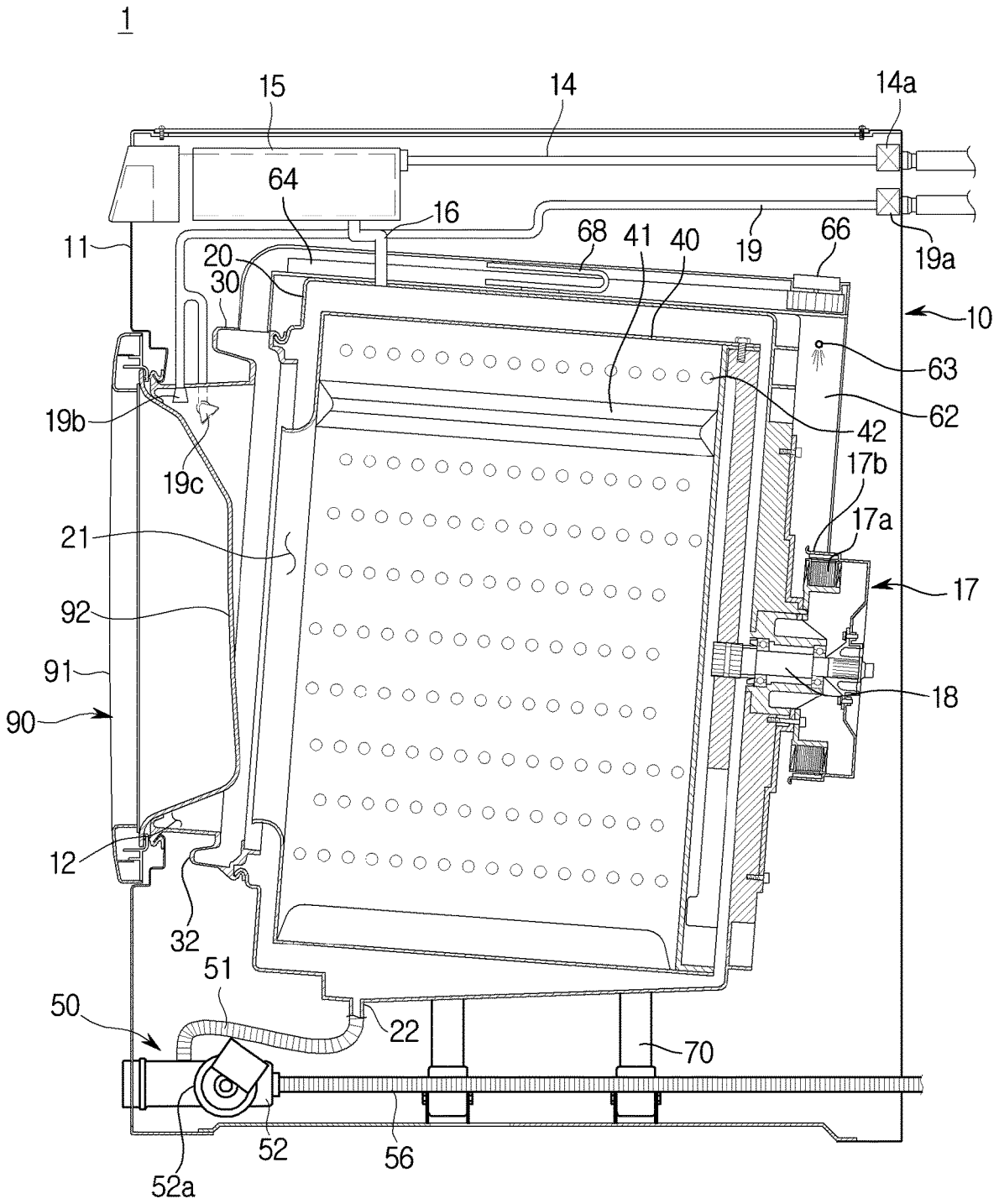
FIG. 2 is a side cross-sectional view of a washing machine according to an embodiment of the present disclosure.
Figure 3:
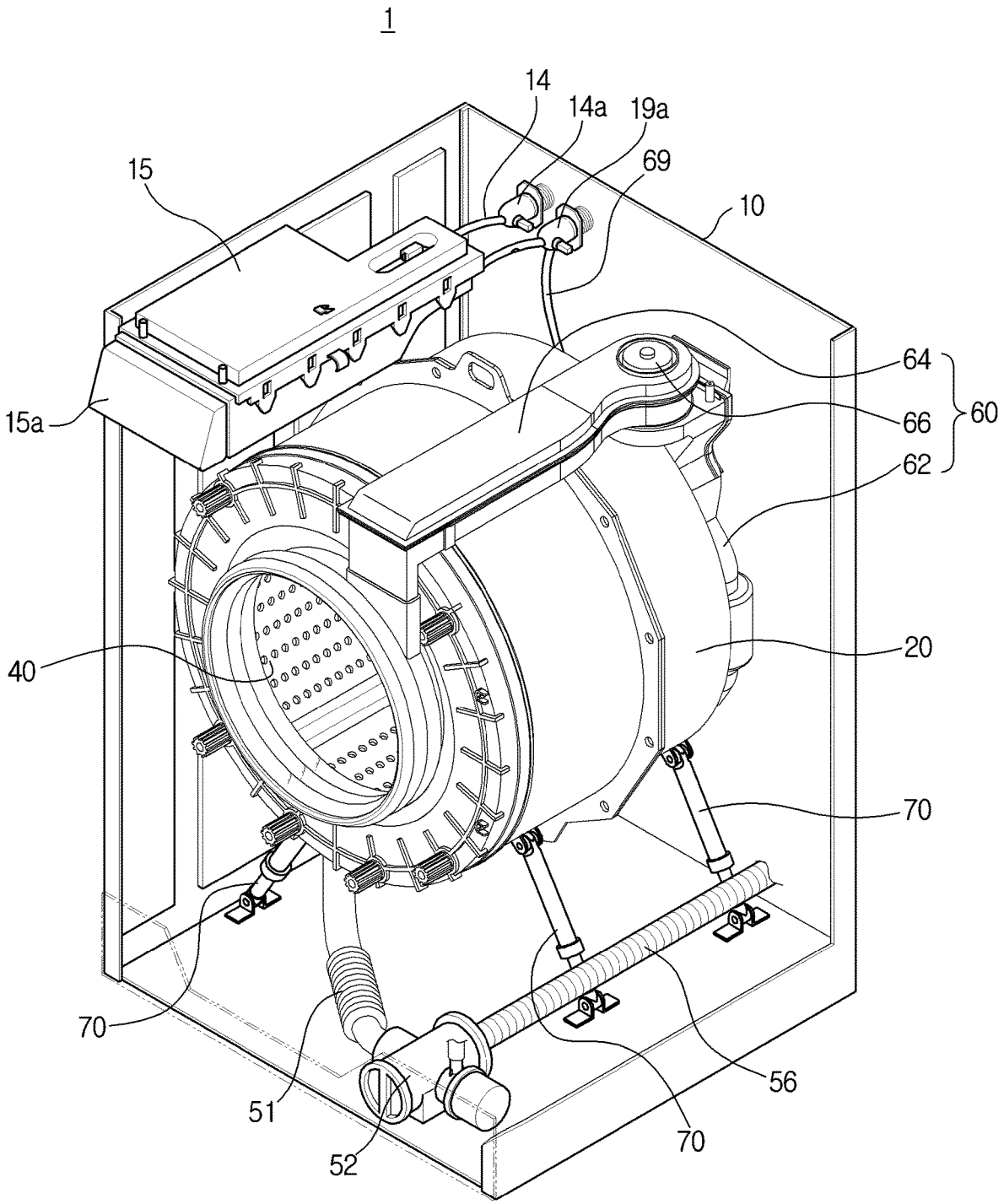
FIG. 3 is a perspective view illustrating an internal structure of a washing machine according to an embodiment of the present disclosure.

FIG. 1 is an external view of a washing machine according to an embodiment of the present disclosure, FIG. 2 is a side cross-sectional view of a washing machine according to an embodiment of the present disclosure, and FIG. 3 is a perspective view illustrating an internal structure of a washing machine according to an embodiment of the present disclosure.

Referring to FIGS. 1 to 3, a washing machine 1 may include a main body 10 which forms an outer appearance and accommodates various components therein, a tub 20 provided inside the main body 10 to store washing water, a drum 40 that receives laundry and rotates, and a motor 17 that rotates the drum 40.

The main body 10 may have a substantially box shape, and may have a front panel 11, a rear panel, a top panel, a bottom panel, and side panels.

The front panel 11 may be provided with a control panel 140 having an input unit 141 for receiving a control command from a user and a display 142 for displaying operation information of the washing machine 1 and guiding the user's input. In addition, the front panel 11 may be provided with an inlet 12 to allow laundry to be introduced into the drum 40.

The inlet 12 of the main body 10 may be opened or closed by a door 90. The door 90 may be rotatably coupled to the main body 10 by a hinge member, and may be composed of a door frame 91 and a glass member 92.

The glass member 92 may be formed of a transparent tempered glass so that the inside of the main body 10 can be seen through. The glass member 92 may protrude toward the inside of the tub 20 to prevent laundry from being biased toward the door 90.

The tub 20 may store washing water and be formed into a substantially cylindrical shape, and may be fixed to the inside of the main body 10. An opening 21 may be formed in the front surface of the tub 20 to correspond to the inlet 12.

In order to reduce vibration generated during the rotation of the drum 40, dampers 70 for movably supporting the tub 20 may be provided under the tub 20.

The inlet 12 of the front panel 11 and the opening 21 of the tub 20 may be connected by a diaphragm 30. The diaphragm 30 may have a substantially ring shape, and may form a passage between the inlet 12 of the front panel 11 and the opening 21 of the tub 20 to guide the laundry introduced into the inlet 12 into the drum 40. In addition, the diaphragm 30 may prevent the vibration generated during the rotation of the drum 40 from being transmitted to the main body 10. To this end, the diaphragm 30 may be formed of a resilient rubber material and include a buffer portion 32 that is bent between the main body 10 and the tub 20.

The drum 40 may have a substantially cylindrical shape with its front surface opened, and may be provided inside the tub 20. The drum 40 may rotate inside the tub 20, and may perform washing by lifting and dropping laundry while rotating. To this end, a plurality of lifters 41 may be provided on the inner circumferential surface of the drum 40 to lift the laundry when the drum 40 rotates. In addition, a plurality of through holes 42 may be formed on the surface of the drum 40 to allow the washing water stored in the tub 20 to flow therethrough.

A first water supply pipe 14 for supplying washing water to the inside of the tub 20 may be provided on an upper portion of the tub 20. The washing water may be supplied from an external water supply source through the first water supply pipe 14. The first water supply pipe 14 may be opened or closed by a first water supply valve 14*a*.

Further, a second water supply pipe 19 for supplying washing water to the inside of the washing machine 1 may be provided on an upper portion of the tub 20. The washing water may be supplied from an external water supply source through the second water supply pipe 19. The second water supply pipe 19 may be opened or closed by a second water supply valve 19*a*.

A detergent supply device 15 for supplying detergent to the tub 20 may be provided at a front upper portion of the main body 10. The inside of the detergent supply device 15 may be partitioned into a plurality of spaces, and the user may input detergent or a rinsing agent into each space. The detergent supply device 15 includes a cover 15*a*.

The detergent supply device 15 may be connected to the tub 20 through a detergent supply pipe 16. The washing water supplied through the first water supply pipe 14 may be supplied to the inside of the tub 20 together with the detergent via the detergent supply device 15.

On the other hand, the washing water supplied through the second water supply pipe 19 may be supplied to the inside of the washing machine 1 without passing through the detergent supply device 15. As a result, the washing water supplied through the second water supply pipe 19 may not contain detergent.

In the following embodiments, the water supplied to the washing machine 1 or discharged from the washing machine 1 will be referred to as washing water regardless of its usage or contamination degree for convenience of explanation.

The motor 17 may be provided on a rear surface of the tub 20 to generate a rotational force to provide the rotational force to the drum 40. The motor 17 includes a fixed stator 17*a* and a rotor 17*b* which rotates in electromagnetic interaction with the stator 17*a* so as to convert the electric force into a mechanical rotational force.

The rotational force generated by the motor 17 may be transmitted to the drum 40 through a drive shaft 18. The drive shaft 18 may be provided to be press-fitted into the rotor 17*b* of the motor 17 so as to rotate together with the rotor 17*b*, and may penetrate a rear wall of the tub 20 to connect the drum 40 and the motor 17.

The washing machine 1 may include a drainage device 50 for discharging the washing water drained from the tub 20 to the outside. The drainage device 50 may include a pump chamber 52 provided below the tub 20 to store the washing water drained from the tub 20, a connection hose 51 for connecting the pump chamber 52 and a drain port 22 of the tub 20, and a drain hose 56 for guiding the washing water stored in the pump chamber 52 to the outside.

The connection hose 51 may guide the washing water, which has been supplied to the tub 20 and used for washing, to the pump chamber 52. As a result, the washing water that has been used for washing may be stored in the pump chamber 52.

A drain pump 52*a* for discharging the stored washing water to the outside of the main body 10 may be provided in the pump chamber 52, and the washing water pumped by the drain pump 52*a* may be guided to the outside of the main body 10 through the drain hose 56.

Further, the washing machine 1 may include a drying device 60 for drying the laundry inside the drum 40. As an example, the drying device 60 may include a circulation duct 62 into which air flows from the drum 40, a drying duct 64 which discharges air into the drum 40, and a blowing fan 66 for forming a flow of air between the circulation duct 62 and the drying duct 64.

The circulation duct 62 may be provided with a water supply nozzle 63 for supplying condensed water (cold water) into the circulation duct 62. When the condensed water is supplied to the inside of the circulation duct 62 through the water supply nozzle 63, moisture generated through drying of the laundry may be condensed and removed by passing through the circulation duct 62. The water supply nozzle 63 is connected to a condensation water supply pipe 69 for supplying condensed water and the condensation water supply pipe 69 is connected to the second water supply valve 19*a*.

The contact between the hot and humid air rising from the bottom and the condensed water is increased by spraying the condensed water supplied through the second water supply valve 19*a* from the water supply nozzle 63 via the condensation water supply pipe 69 and flowing it down along the inner surface of the circulation duct 62, thereby improving the condensation effect.

A discharge pipe (not shown) for discharging the condensed water to the outside may be connected to the circulation duct 62. The discharge pipe is connected to the drain hose 56 to guide the condensed water generated in the circulation duct 62 to the drain hose 56.

The drying duct 64 may extend forward from a rear of the tub 20 and may be connected to the circulation duct 62 connected to the rear surface of the tub 20.

The drying duct 64 is provided with a heater 68 for heating the air inside thereof. The air heated by the heater 68 is supplied to the inside of the drum 40 through the drying duct 64, and the air in the drum 40 flows into the drying duct 64 through the circulation duct 62 again. When a drying course proceeds, the air discharged from the drum 40 to the circulation duct 62 may be heat-exchanged when the air passes through the circulation duct 62 to remove moisture.

In addition, the air may be supplied to the inside of the drum 40 by operating the blowing fan 66 during a waterless process which will be described later, and the contaminants contained in the air flowing into the circulation duct 62 may be washed by the condensed water sprayed from the water supply nozzle 63 and discharged through the discharge pipe. It is also possible to supply hot air into the drum 40 by operating the heater 68.

One end of the second water supply pipe 19 may be connected to the outside to receive the washing water and the other end thereof may be branched to be connected to a door cleaning nozzle 19*b* and a cleaning reinforcing nozzle 19*c*, respectively. According to an embodiment, it is also possible to omit at least one of the door cleaning nozzle 19*b* and the cleaning reinforcing nozzle 19*c*.

The door cleaning nozzle 19*b* may be installed on the diaphragm 30 to spray the washing water to the door 90. Specifically, the door cleaning nozzle 19*b* is disposed at the upper center of the diaphragm 30, so that the washing water may be sprayed vertically downward. As described above, the glass member 92 of the door 90 is provided to protrude toward the inside of the tub 20, and the washing water sprayed vertically downward may clean the door 90 by reaching the protruding glass member 92 of the door 90.

The cleaning reinforcing nozzle 19*c* may be installed to the diaphragm 30 to spray the washing water into the drum 40. Specifically, the cleaning reinforcing nozzle 19*c* may be provided to be inclined toward the inside of the drum 40 so as to have a spray angle that does not interfere with the protruding door 90. FIGS. 1 and 2 illustrate the case where the cleaning reinforcing nozzle 19*c* is installed at an upper left side of the diaphragm 30, but it may be installed at various positions on the diaphragm 30 within the technical idea that the washing water is not subject to the interference of the door 90.

A part of the washing water sprayed through the door cleaning nozzle 19*b* and the cleaning reinforcing nozzle 19*c* may be used to wash the diaphragm 30 by flowing into the diaphragm 30 as well as the door 90 or the inside of the drum 40.

Meanwhile, the washing machine 1 according to an embodiment of the present disclosure may separate contaminants from the laundry through the waterless process before performing the main washing process. Herein, the waterless process may be referred to as a process using a mechanical force generated through the rotation of the drum 40 without supplying washing water to the washing machine 1, and the main washing process may be referred to as a regular process including washing, rinsing and dehydrating courses.

The glass member 92 of the door 90 may be contaminated by contaminants or the like separated from the laundry at the time of the waterless process. In addition, contaminants separated from the laundry may be accumulated in the buffer portion 32.

The washing machine 1 according to an embodiment of the present disclosure may prevent the contaminants separated through the waterless process from contaminating the laundry again in the main washing process by carrying out the main washing process after discharging contaminants separated from the laundry.

Hereinafter, the operation of the washing machine 1 according to an embodiment of the present disclosure will be described in detail with reference to the structure of the washing machine 1 described above.

Figure 4:
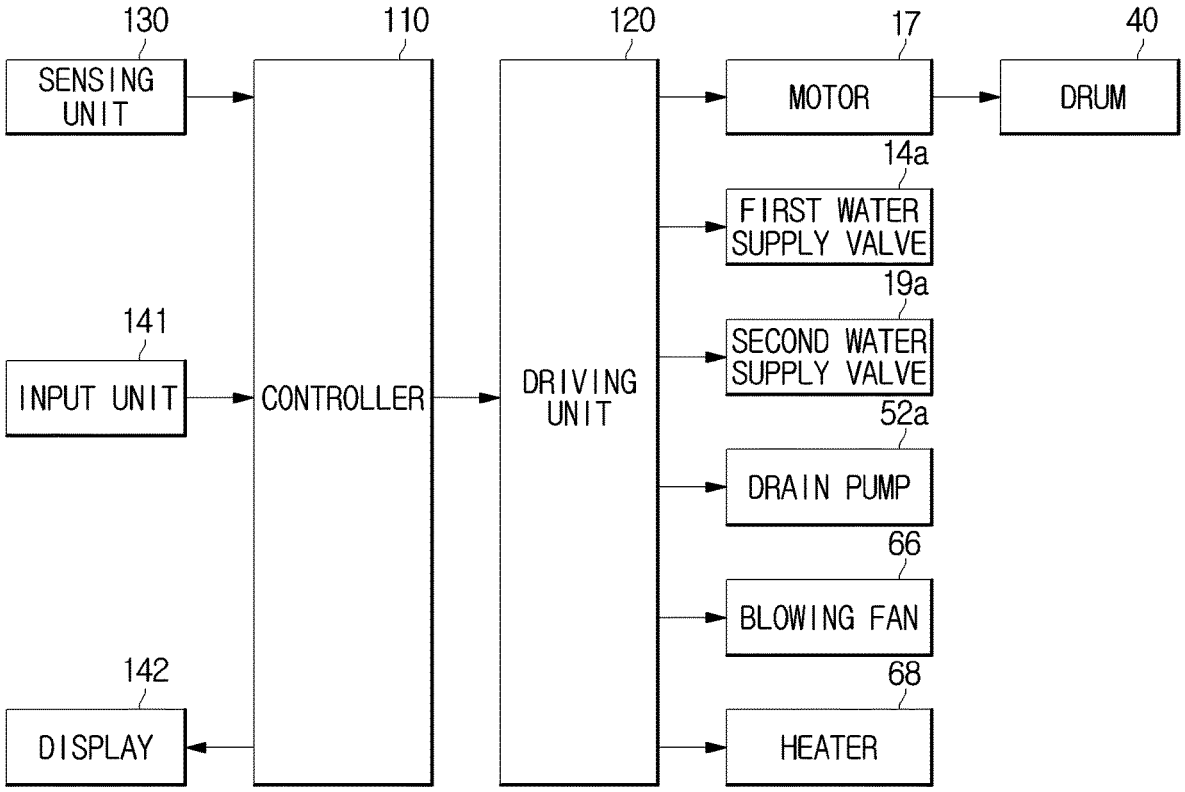
FIG. 4 is a control block diagram of a washing machine according to an embodiment of the present disclosure.

FIG. 4 is a control block diagram of a washing machine according to an embodiment of the present disclosure.

Referring to FIG. 4, the washing machine 1 may include a sensing unit 130 for collecting various data necessary for controlling the operation of the washing machine 1, the input unit 141 for receiving the user's control command, the display 142 for displaying information on the operation of the washing machine 1 and an image for guiding the user's input, a controller 110 for generating a control signal for driving the motor 17, the first water supply valve 14*a*, the second water supply valve 19*a*, the drain pump 52*a*, the blowing fan 66 and the heater 68 based on the input control command and the collected data, and a driving unit 120 for driving the motor 17, the first water supply valve 14*a*, the second water supply valve 19*a*, the drain pump 52*a*, the blowing fan 66 and the heater 68 based on the control signal transmitted from the controller 110.

The sensing unit 130 may include a temperature sensor installed at a front upper portion of the drying duct 64 to sense the temperature of the air flowing into the drum 40, a humidity sensor installed at a front lower end of the drum 40 to sense humidity, a weight sensor for sensing the weight of laundry, a current sensor for sensing the volume of laundry, a water level sensor for sensing the water level of the water stored in the tub 20, and the like. The description of the positions of the temperature sensor and the humidity sensor described above is merely an example applicable to the washing machine 1 and they may be provided at other positions capable of sensing the temperature or humidity in addition to the above-described example.

The weight of laundry may be sensed using a load cell, a piezoelectric sensor, a proximity sensor, or the like. Alternatively, the weight of laundry may be sensed using the time required to reach a predetermined speed (or a predetermined number of revolutions) by using the instantaneous acceleration of the motor 17, and may also be sensed using the second law of motion (torque=Inertia×acceleration) after applying a torque to the motor 17 for a predetermined time and measuring the inertia of the drum 40 directly or indirectly.

The volume of laundry may be sensed by using a change in current of the blowing fan 66 at a constant rotational speed or using a RPM that changes when a constant voltage is supplied to the blowing fan 66.

The input unit 141 may receive a control command for the main washing composed of at least one of the washing course, the rinsing course, the dehydrating course and the drying course, and a control command for a contaminant separation process from the user.

In this embodiment, the contaminant separation process comprehensively includes a process for removing contaminants in laundry by controlling a mechanical force and temperature without using water, and may be referred to as various names such as a waterless process, a bedding care course, a mite removal course, a dust removal course, and the like. For example, the drum 40 may be rotated according to a certain RPM and operation rate without supplying washing water to the tub 20 so that the laundry is tumbled repeatedly to rise and fall, and the contaminants present in the laundry may be separated by the tumbling. The specific operation of the washing machine 1 for separating contaminants of the laundry will be described later.

The input unit 141 may be implemented in the form of a button selected by pressing, may be implemented as a touch pad selected by a touch operation, or may be implemented in the form of a jog shuttle in which commands are input such a manner of rotating clockwise or counterclockwise or pushing in the up, down, left, and right directions. The input unit 141 needs only to be able to receive the user's control command, and there is no limit to the form thereof.

The display 142 may display an image for guiding an input of the user or may display information on a process currently in progress in the washing machine 1.

A light emitting diode (LED) panel, a liquid crystal display (LCD) panel, or an organic light emitting diode (OLED) panel may be employed as the display 142, or the display 142 may be provided in the form of a touch screen integrated with the input unit 141.

The controller 110 may be implemented as a microcomputer that controls the operation of the washing machine 1 as a whole. When the controller 110 is referred to as controlling a component of the washing machine 1 in the embodiments to be described later, it may include all the case of transmitting a control signal directly to the component, the case of transmitting a control signal to a separate driving device for driving the component, and the case of transmitting a control signal to another intermediate component necessary for controlling the component.

For example, in the case where the controller 110 controls the drum 40 to rotate, it may include a case of transmitting a control signal to the motor 17, which drives the drum 40, to cause the motor 17 to drive the drum 40.

The controller 110 may include at least one memory for storing programs for executing the above-described operations and the operations that will be described later and various data, and at least one processor for executing the programs stored in the memory to process the data.

The memory may include at least one of a volatile memory such as a static random access memory (S-RAM) and a dynamic random access memory (D-RAM); and a nonvolatile memory such as a flash memory, a read only memory (ROM), an erasable programmable read only memory (EPROM), and an electrically erasable programmable read only memory (EEPROM).

The nonvolatile memory may operate as an auxiliary storage device of the volatile memory and may retain the stored data even when the power of the washing machine 1 is shut off. For example, the nonvolatile memory may store control programs and control data for controlling the operation of the washing machine 1.

Unlike the nonvolatile memory, the volatile memory may lose stored data when the power of the washing machine 1 is shut off. The volatile memory may temporarily store the control program and the control data loaded from the nonvolatile memory, temporarily store the set value or the control command input through the input unit 141, or temporarily store the control signal or the like output from the processor.

The processor may process data or output a control signal according to a program stored in the memory.

The processor and the memory may be provided in a single configuration or a plurality of configurations depending on their capacities. Further, the processor and the memory may be provided to be physically separated or may be provided as a single chip.

Hereinafter, a washing machine according to an embodiment and a control method of the washing machine according to an embodiment will be described together. In carrying out the control method of a washing machine according to an embodiment, the washing machine 1 described above with reference to FIGS. 1 to 4 may be used.

Figure 5:
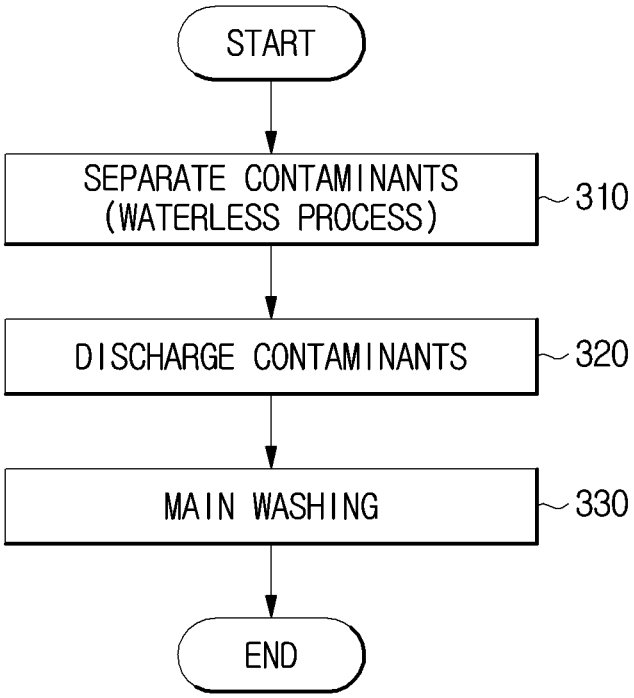
FIG. 5 is a flowchart of a control method of a washing machine according to an embodiment of the present disclosure.

FIG. 5 is a flowchart of a control method of a washing machine according to an embodiment of the present disclosure.

Referring to FIG. 5, the washing machine 1 performs separation of contaminants through a waterless process (310), and proceeds through a process (320) of discharging contaminants separated from the laundry through the waterless process. According to the type of waterless process, it is possible to start the contaminant discharge process after the separation of the contaminants is completed, and it is also possible to simultaneously proceed with the contaminant separation and the contaminant discharge.

When the contaminant discharge process is completed, a main washing process (330) may proceed. For example, the controller 110 may drain the washing water stored in the tub 20 or the pump chamber 52 by operating the drain pump 52*a* for a preset time, finish the contaminant discharge process when the preset time has elapsed, and proceed with the main washing process.

The main washing process may proceed by supplying detergent water to the drum 40. Specifically, when washing water is supplied through the first water supply pipe 14 and the supplied washing water passes through the detergent supply device 15, detergent water may be supplied to the drum 40.

On the other hand, if the user selects the main washing process through the input unit 141, the contaminant separation process may be automatically performed before performing the main washing process. Alternatively, the contaminant separation process may be performed only when the user selects it separately.

Figure 6:
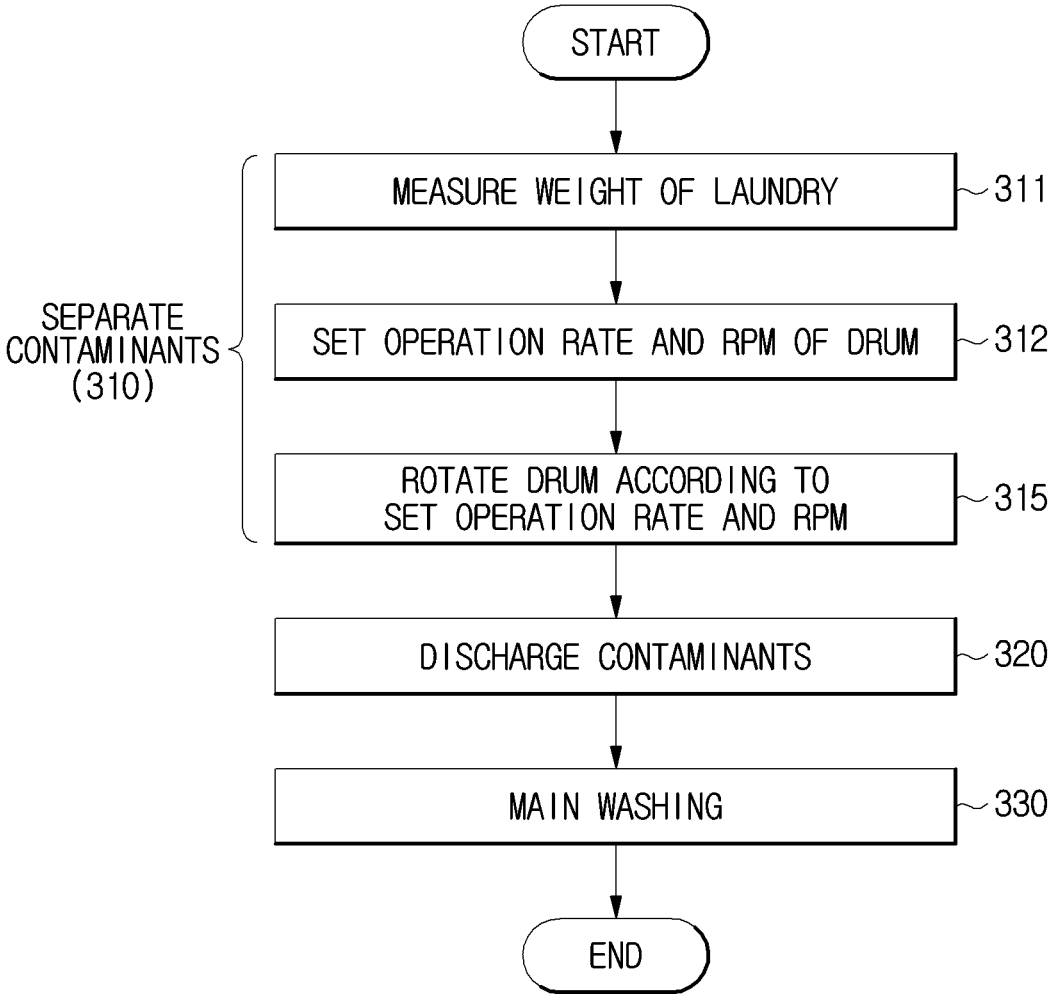
FIGS. 6 to 8 are flowcharts specifically illustrating a contaminant separation process in a control method of a washing machine according to an embodiment of the present disclosure.
Figure 7:
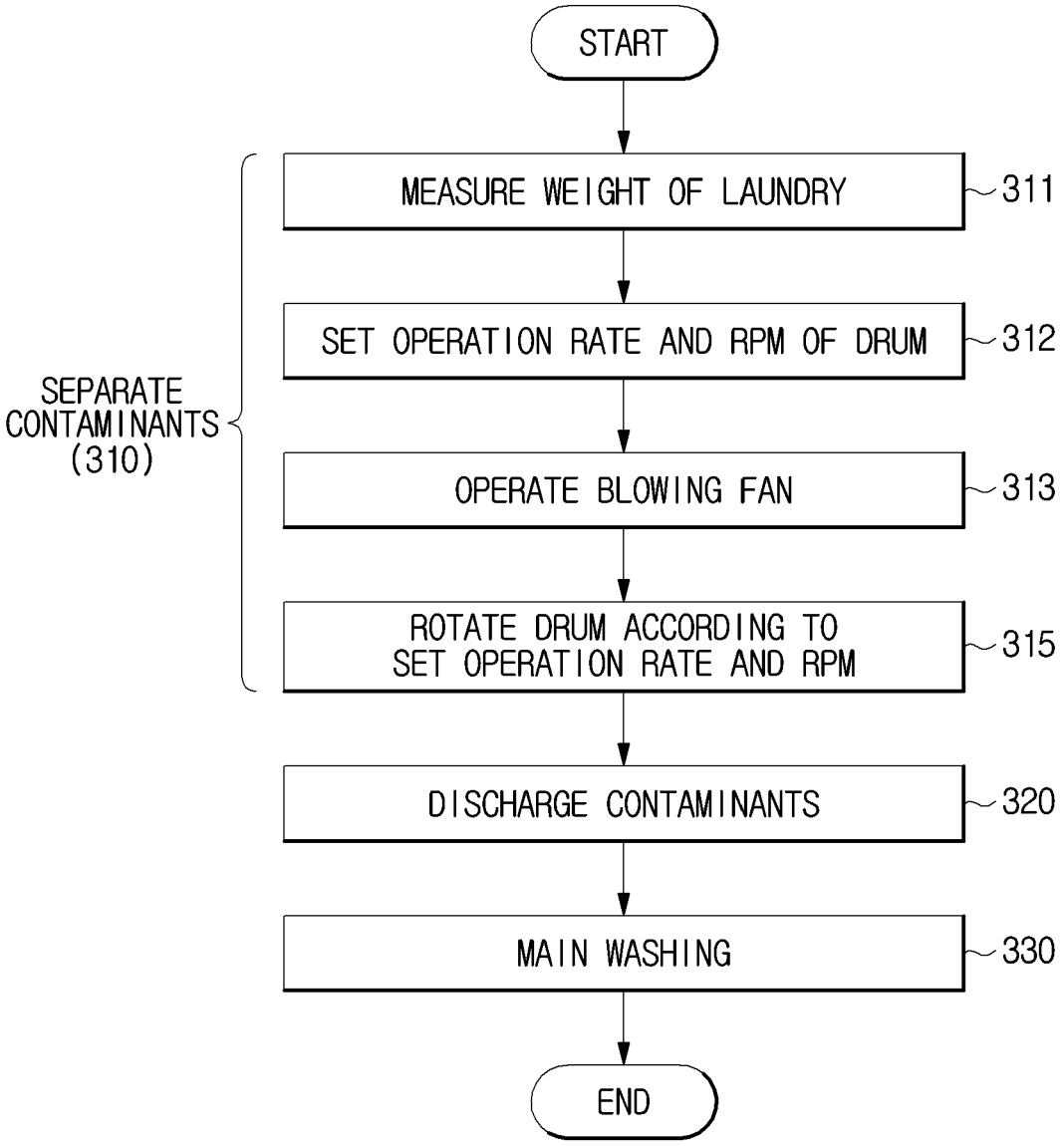
Figure 8:
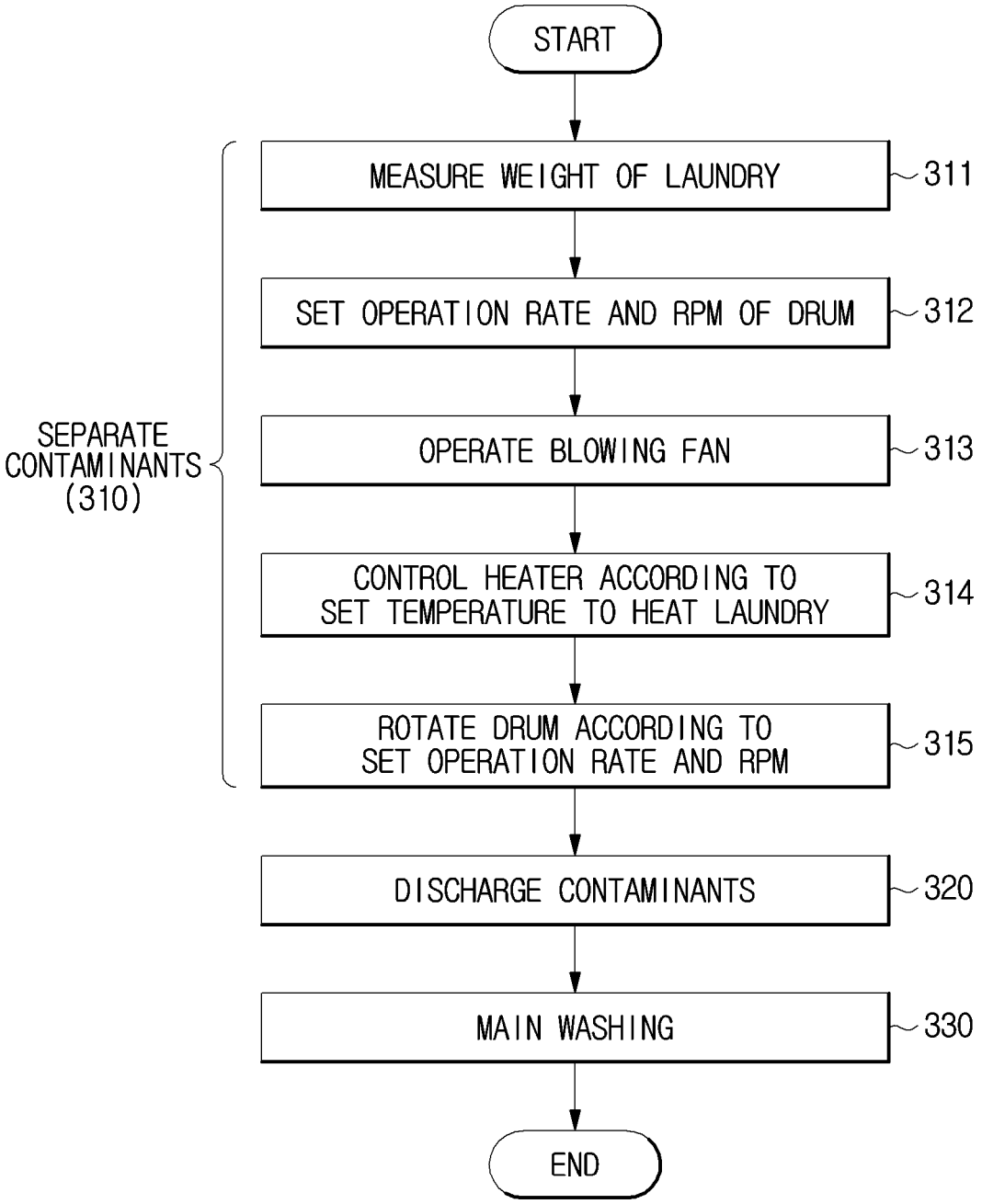

FIGS. 6 to 8 are flowcharts specifically illustrating a contaminant separation process in a control method of a washing machine according to an embodiment of the present disclosure.

Referring to FIG. 6, the sensing unit 130 measures the weight of laundry introduced into the drum 40 (311). Alternatively, the user may input information on the weight of laundry through the input unit 141.

The controller 110 sets an operation rate and an RPM of the drum 40 for providing a mechanical force to the laundry (312). The controller 110 may set the operation rate and the RPM of the drum 40 based on the weight of laundry, and may set a predetermined operation rate and RPM for removing contaminants. In addition, the rotation time, that is, the time for providing the mechanical force may also be set. In the embodiments that will be described later, a factor that determines the rotational motion of the drum 40, such as the operation rate, the RPM, and the rotation time will be referred to as a drum rotation factor.

The RPM of the drum 40 may be set in the range of 20 RPM to 800 RPM, and as an example, the drum 40 may be rotated at 50 RPM to provide a mechanical force. The mechanical force providing time may be set in the range of 5 minutes to 2 hours. The operation rate of the drum 40 may be set to Motor On for 20 seconds/Motor Off for 2 seconds. However, the above numeric values are only examples that may be applied to the washing machine 1 and the control method thereof according to an embodiment of the present disclosure, and a wide range of RPMs, operating rates and times capable of effectively isolating contaminants within a range that does not damage the laundry may be set.

The controller 110 rotates the drum 40 according to the set RPM and operation rate (315). Specifically, the controller 110 may generate a control signal for rotating the drum 40 according to the set RPM and operation rate and transmit the control signal to the driving unit 120, and the driving unit 120 may transmit a driving signal to the motor 17 to rotate the drum 40 according to the set RPM and operation rate. As the drum 40 rotates, the laundry in the drum 40 is tumbled with repeated lifting and dropping, and contaminants present in the laundry may be separated through the tumbling.

Alternatively, as illustrated in FIG. 7, it is also possible to improve the separation efficiency of the contaminants by rotating (315) the drum 40 with the operation (313) of the blowing fan 66. Specifically, the controller 110 generates a control signal for rotating the blowing fan 66 according to a preset air flow rate and transmits the control signal to the driving unit 120.

The strong airflow generated by the operation of the blowing fan 66 may be introduced into the drum 40 through the circulation duct 62, and the strong airflow introduced into the drum 40 may effectively separate contaminants from laundry that is tumbled while rising and falling inside the drum 40 as the drum 40 rotates.

It is easier to separate contaminants from somewhat dried laundry than wet laundry, and depending on the type of contaminants, there may be cases where contaminants are separated from the laundry by heating. Accordingly, as illustrated in FIG. 8, it is also possible to improve the separation efficiency of the contaminants by controlling the heater 68 to supply hot air to the inside of the drum 40 according to the set temperature (314).

Specifically, when air flows inside the washing machine 1 due to the operation of the blowing fan 66, the heater 68 heats the air passing through the drying duct 64 to heat the air flowing inside the washing machine 1. The air (hot air) heated while passing through the drying duct 64 flows into the drum 40. The laundry may be dried by the heated air, and if the temperature of the heated air is high enough to break the chemical bond between the contaminants and the laundry, contaminants that cannot be removed only by the mechanical force may be separated.

When a preset time has elapsed, the process of separating the contaminants, that is, the process of rotating the drum 40 without supplying the washing water may be finished. Herein, the preset time may be a value set according to the measured weight of the laundry, a value set by the user, or a value set as a default value for a process of separating contaminants.

The contaminant separating operation according to FIGS. 6 to 8 as described above is merely an example that may be applied to the washing machine 1 and the control method thereof according to an embodiment of the present disclosure, and the contaminants may be separated from the laundry by combining various factors with the mechanical force of the washing machine.

Figure 9:
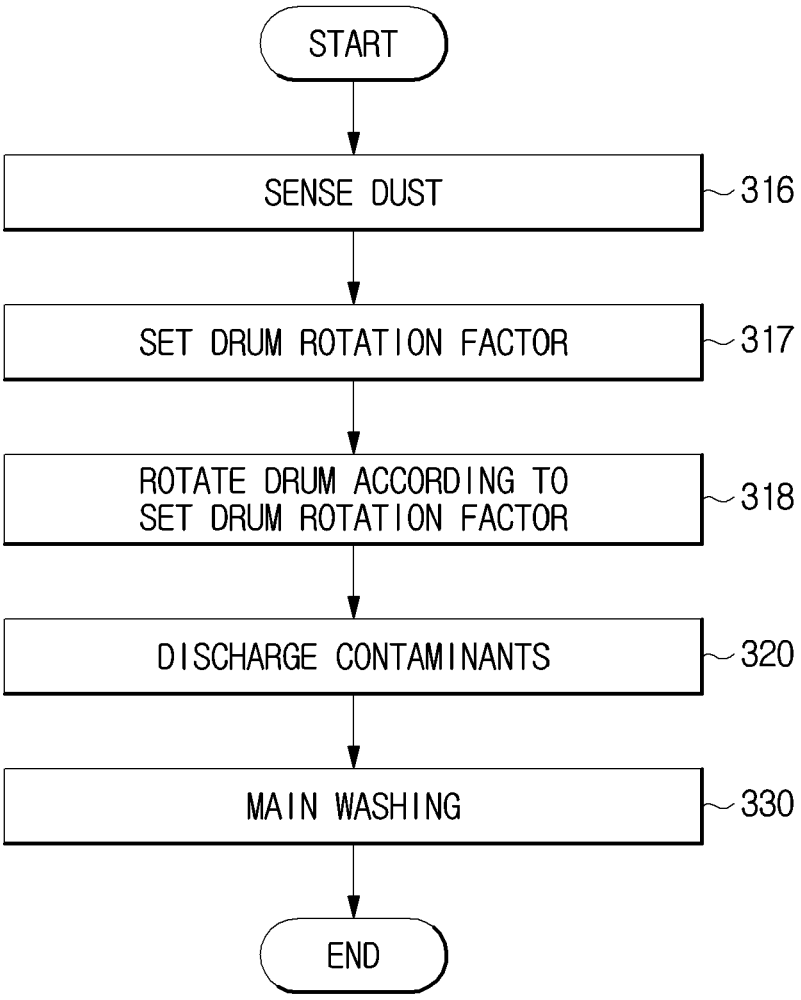
FIGS. 9 and 10 are flowcharts illustrating examples of determining the mechanical force of a washing machine based on the amount of dust in a control method of the washing machine according to an embodiment of the present disclosure.
Figure 10:
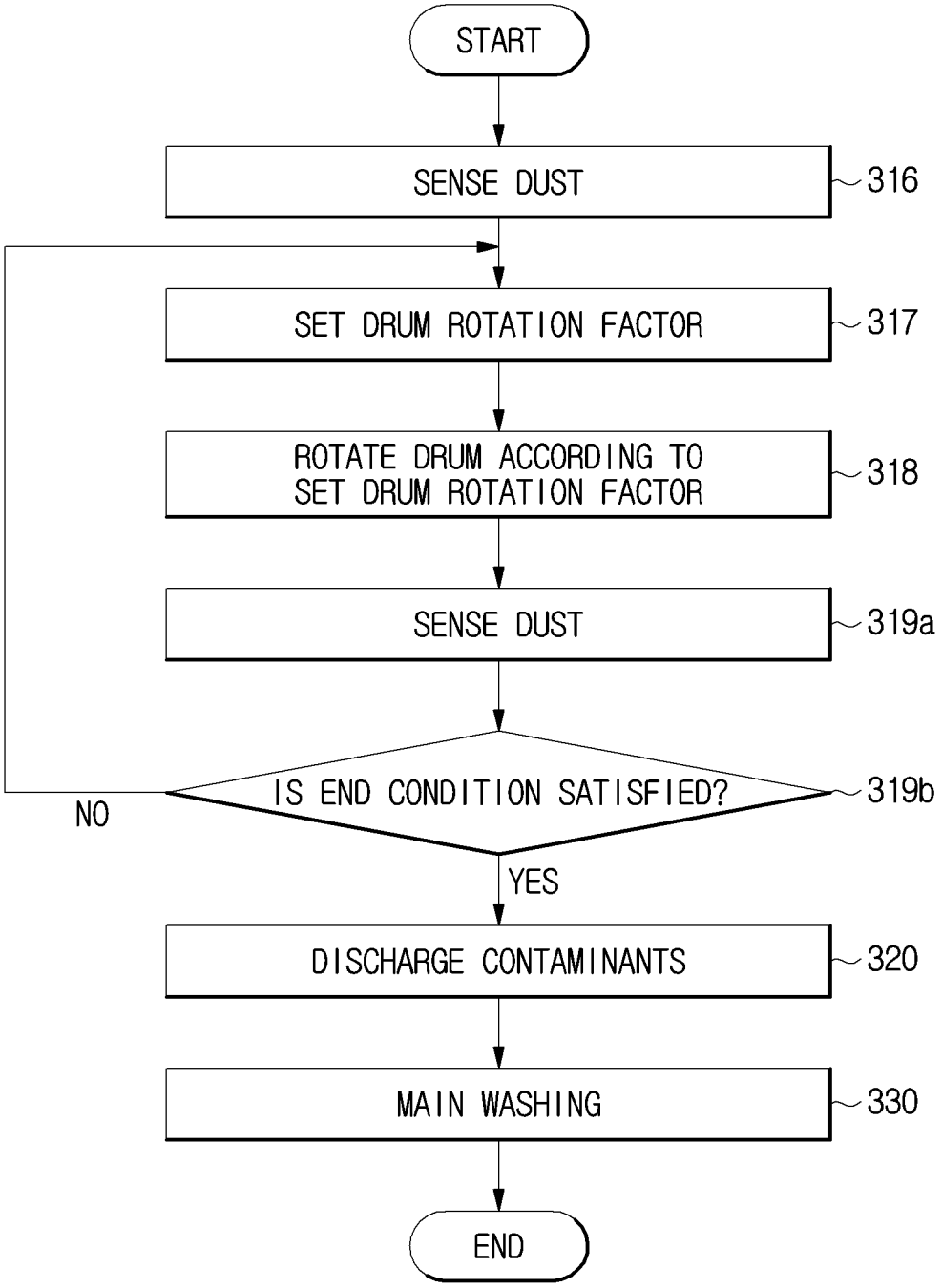

FIGS. 9 and 10 are flowcharts illustrating examples of determining the mechanical force of a washing machine based on the amount of dust in a control method of the washing machine according to an embodiment of the present disclosure.

Referring to FIG. 9, before performing the contaminant separation process, the washing machine 1 may sense dust (316). To this end, the sensing unit 130 may further include a dust sensor, and the dust sensor is provided in the tub 20 or the circulation duct 62 to sense the amount of dust that has flowed into the washing machine 1 together with the laundry. For example, the dust sensor may measure the dust concentration inside the washing machine 1.

The controller 110 may set a drum rotation factor based on the sensed dust amount (317). As described above, the drum rotation factor may include at least one of the RPM, the operation rate, and the rotation time of the drum 40. For example, at least one reference value for classifying the degree of dust amount may be set, and the degree of dust amount may be determined by comparing the sensed dust amount with the set reference value. In addition, the drum rotation factor value corresponding to the degree of dust amount may be stored in advance in the form of a lookup table, and a value corresponding to the degree of the sensed dust amount may be set to the drum rotation factor.

Alternatively, it is also possible to acquire the drum rotation factor by storing in advance a formula with the dust amount as a variable and with the drum rotation factor as a function value, and substituting the sensed dust amount into the stored formula.

As a specific example, if the sensed dust amount is equal to or greater than the set reference value, the controller 110 may set the RPM to 50 and set the rotation time to 1 hour.

The controller 110 rotates the drum 40 according to the set drum rotation factor (318). When the set rotation time has elapsed, the controller 110 may stop the rotation of the drum 40 and perform the contaminant discharge (320) and the main washing (330).

On the other hand, in this embodiment, it is possible to operate the blowing fan 66 in order to separate contaminants, and it is also possible to heat the laundry by controlling the heater according to the set temperature.

In setting the drum rotation factor, it is also possible to consider both the sensed dust amount and the weight of the laundry. In this case, the controller 110 may set the drum rotation factor based on the sensed dust amount and the weight of the laundry. As described above, it is possible to store in advance the drum rotation factor value corresponding to the dust amount and the weight of the laundry in the form of a lookup table, and it is also possible to store in advance a formula with the dust amount and the weight of the laundry as variables and with the drum rotation factor as a function value.

On the other hand, it is also possible to confirm the dust amount again before finishing the contaminant separation process. As illustrated in FIG. 10, when the dust sensor senses the dust (316), and the controller 110 sets the drum rotation factor based on the sensed dust amount (317) and rotates the drum 40 according to the set drum rotation factor (318), dust may be sensed (319*a*) using the dust sensor again. However, the sensing of dust may be performed in real time or periodically until the contaminant separation process is completed, or may be performed again after the rotation of the drum 40 is stopped according to the set drum rotation factor.

The controller 110 determines whether the end condition of the contaminant separation process is satisfied (319*b*). For example, if the re-sensed dust amount is less than the set reference value, it may be determined that the end condition is satisfied (YES in 319*b*). If the re-sensed dust amount is more than the set reference value, it may be determined that the end condition is not satisfied (NO in 319*b*), the drum rotation factor may be set (317) again based on the re-sensed dust amount, and the operation of rotating the drum 40 according to the set drum rotation factor (318) may be repeated.

Alternatively, it is also possible that a predetermined default value is set to the drum rotation factor or the drum rotation factor is set based on the user's input at the time of the initial drum rotation for contaminant separation and it is determined whether the contaminant separation process is to be ended or the drum 40 is to be rotated again by sensing the dust using the dust sensor after the rotation of the drum 40 is completed.

Figure 11:
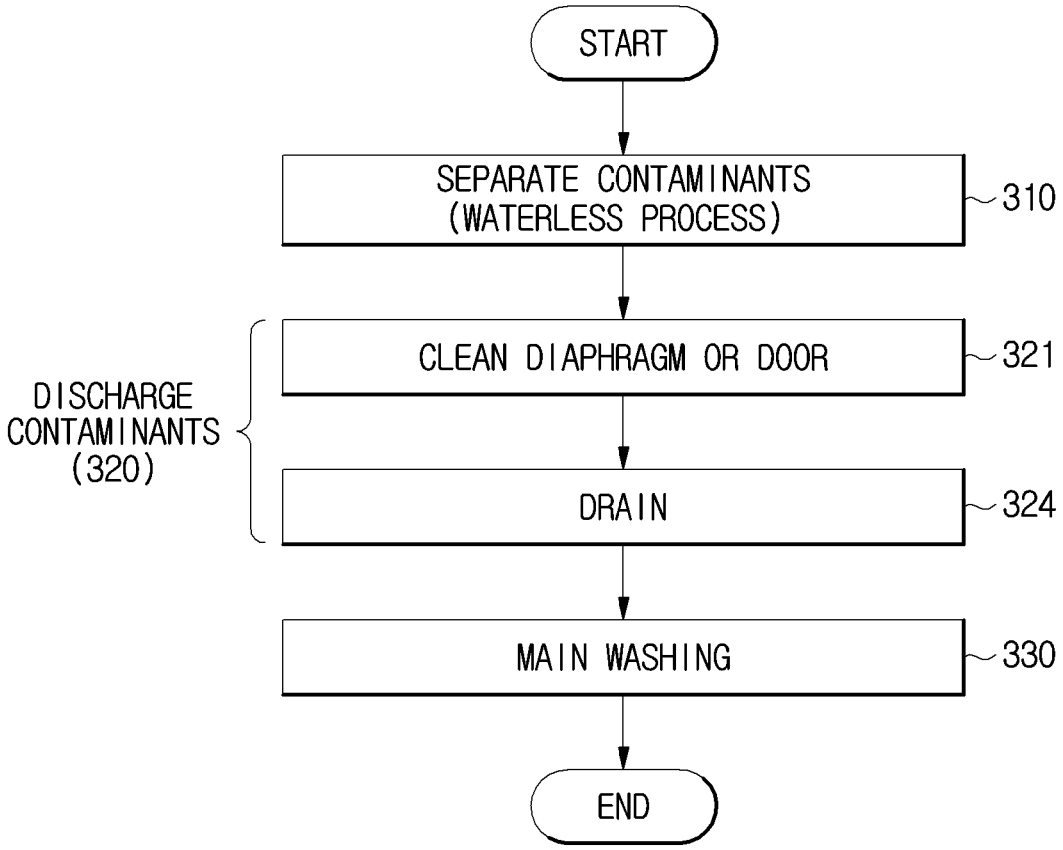
FIG. 11 is a flowchart specifically illustrating the operation of discharging separated contaminants in a control method of a washing machine according to an embodiment of the present disclosure.

FIG. 11 is a flowchart specifically illustrating the operation of discharging separated contaminants in a control method of a washing machine according to an embodiment of the present disclosure.

Referring to FIG. 11, when the process of separating the contaminants is ended, the contaminants may be discharged by cleaning the diaphragm 30 or the door 90 (321) and draining the washing water (324). As described earlier, it is also possible that the separation and discharge of the contaminants are performed simultaneously.

Cleaning of the diaphragm 30 or the door 90 may be performed for a preset time. The cleaning time of the diaphragm 30 or the door 90 may be set by the user or may be set by the controller 110 based on the weight of the laundry or the dust amount or may be a value set as a default for cleaning the diaphragm 30 or the door 90.

The contaminants separated from the laundry may adhere to the door 90 or may be accumulated in the diaphragm 30 or may be introduced between the drum 40 and the tub 20. If the main washing process proceeds in this state, the separated contaminants may be mixed with the laundry again, and in the end, the contaminants may not be effectively removed. Accordingly, in the washing machine 1 and the control method thereof according to an embodiment of the present disclosure, the main washing process proceeds after the separated contaminants are discharged to the outside through the waterless process, so that the contaminants may be prevented from being mixed with the laundry again and effective contaminant removal may be realized.

Figure 12:
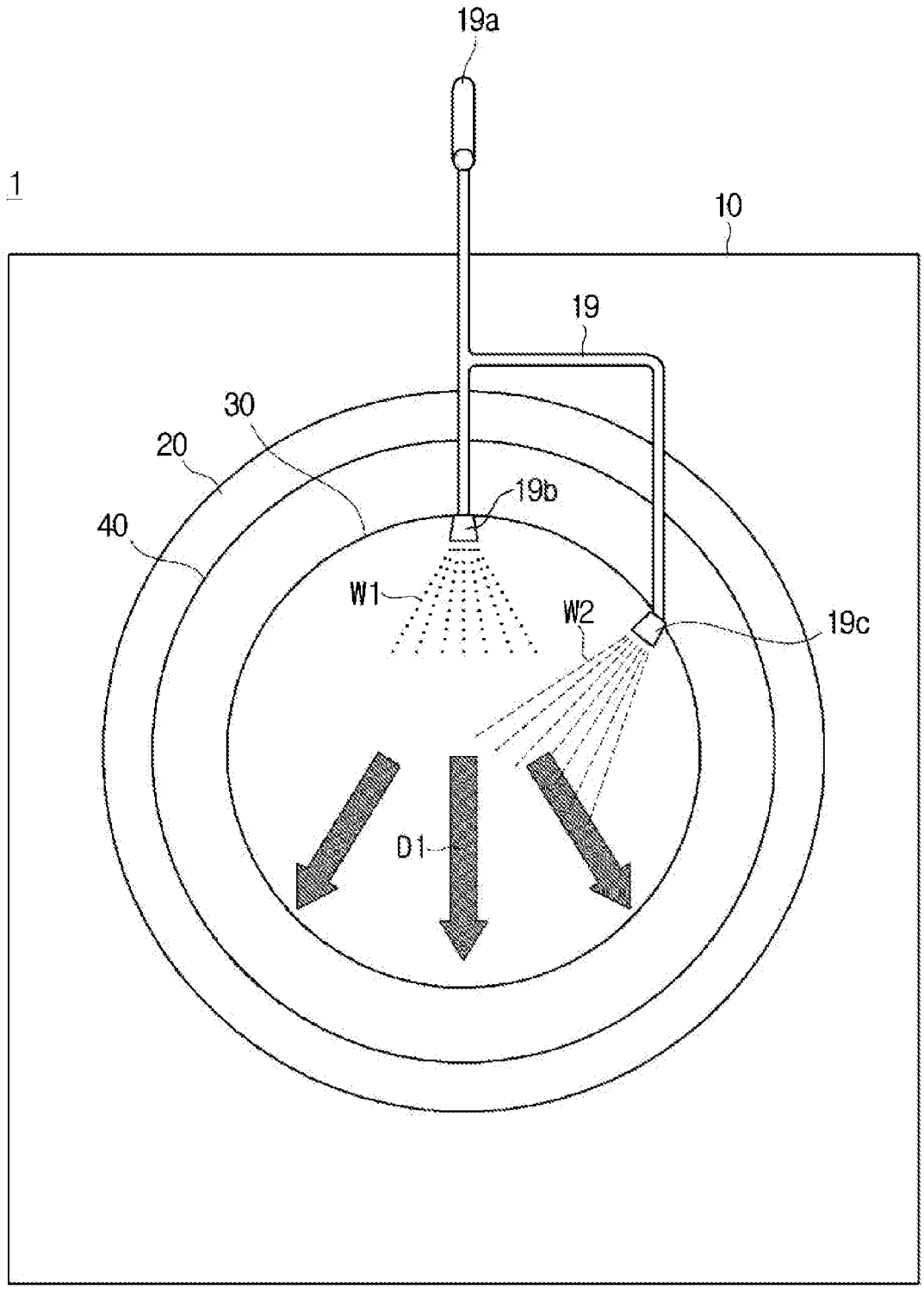
FIGS. 12 and 13 are views for explaining a diaphragm cleaning method of a washing machine according to an embodiment of the present disclosure.

Cleaning of the door 90 and the diaphragm 30 may be performed using at least one of the door cleaning nozzle 19*b*, the cleaning reinforcing nozzle 19*c* and a diaphragm cleaning nozzle 400 (refer to FIG. 12).

Figure 13:
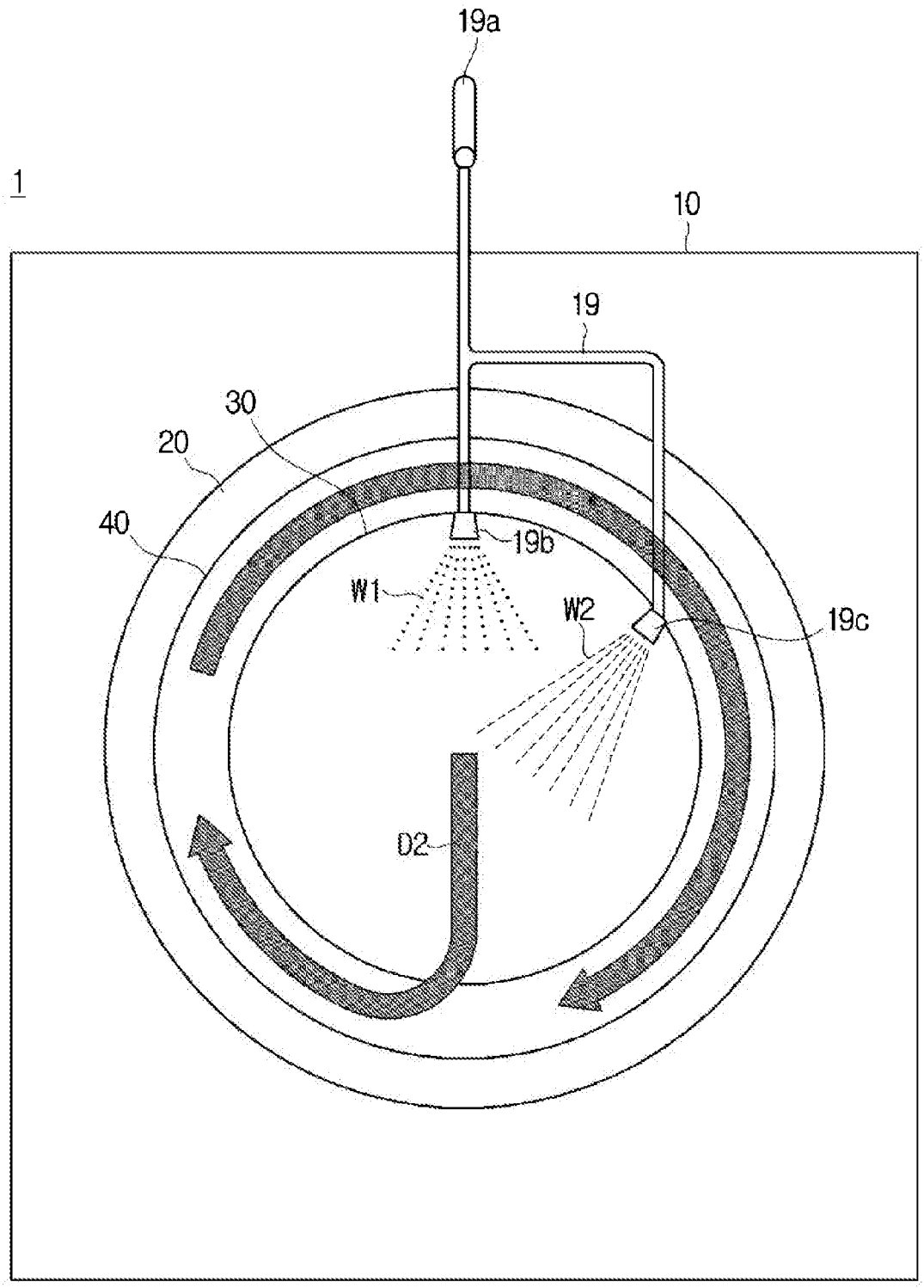

FIGS. 12 and 13 are views for explaining a diaphragm cleaning method of a washing machine according to an embodiment of the present disclosure.

FIGS. 12 and 13 illustrate a case where when the washing machine 1 is viewed from the front, the tub 20, the drum 40, and the diaphragm 30 are concentric with each other and have large diameters in that order. Also, FIG. 12 illustrates a case where the drum 40 is stopped or rotated at a low speed, and FIG. 13 illustrates a case where the drum 40 rotates at a high speed. In FIGS. 12 and 13, it is assumed that the drum 40 rotates in the clockwise direction for convenience of explanation.

Referring to FIG. 12, the controller 110 may spray the washing water through the door cleaning nozzle 19*b* and the cleaning reinforcing nozzle 19*c*. To this end, the controller 110 may control the second water supply valve 19*a* of the second water supply pipe 19, or may directly control the door cleaning nozzle 19*b* and the cleaning reinforcing nozzle 19*c*.

The door cleaning nozzle 19*b* is provided to spray washing water W1 toward the door 90 and the cleaning reinforcing nozzle 19*c* is provided to spray washing water W2 toward the inside of the drum 40, but a part of the washing water to be sprayed may flow into the buffer portion 32, which is a bent region of the diaphragm 30. The washing water W1 and W2 introduced into the buffer portion 32 as described above may be used for cleaning the diaphragm 30.

As illustrated in FIG. 12, when the drum 40 stops or rotates at a low speed, the washing water W1 supplied through the door cleaning nozzle 19*b* and the washing water W2 supplied through the cleaning reinforcing nozzle 19*c* proceed in a direction D1 by gravity. That is, the washing water W1 and W2 sprayed through the door cleaning nozzle 19*b* and the cleaning reinforcing nozzle 19*c*, respectively, may move toward a lower portion of the diaphragm 30 because there is no external force applied to the washing water other than gravity. As a result, the washing water W1 and W2 may not be introduced into the buffer portion 32 of the diaphragm 30, or only a very small amount of the washing water W1 and W2 may be introduced into the buffer portion 32.

Accordingly, the controller 110 may provide an external force to allow the supplied washing water to flow into the buffer portion 32 of the diaphragm 30 by controlling the motor 17 to rotate the drum 40 at a high speed. The controller 110 may rotate the drum 40 at a speed selected from a range of 200 RPM to 1200 RPM.

As illustrated in FIG. 13, when the drum 40 rotates at a high speed, the air inside the drum 40 may rotate and flow clockwise from a center portion to an outer portion. As a specific example, more than 0.5 L of washing water may be supplied through the nozzle 19*b* or 19*c* while rotating the drum 40 at a speed of 500 RPM or higher.

When a force due to the flow of air is applied to the washing water W1 and W2, the washing water W1 and W2 also rotate in the clockwise direction and may flow into the buffer portion 32 of the diaphragm 30. As a result, the washing water W1 and W2 flowing into the buffer portion 32 rotate in a direction D2 and may remove contaminants. At this time, the door 90 may also be cleaned together.

It is also possible that the washing machine 1 further includes a separate means for cleaning the diaphragm 30 in addition to the door cleaning nozzle 19*b* and the cleaning reinforcing nozzle 19*c*. Hereinafter, a description will be given with reference to FIGS. 12 to 14.

Figure 14:
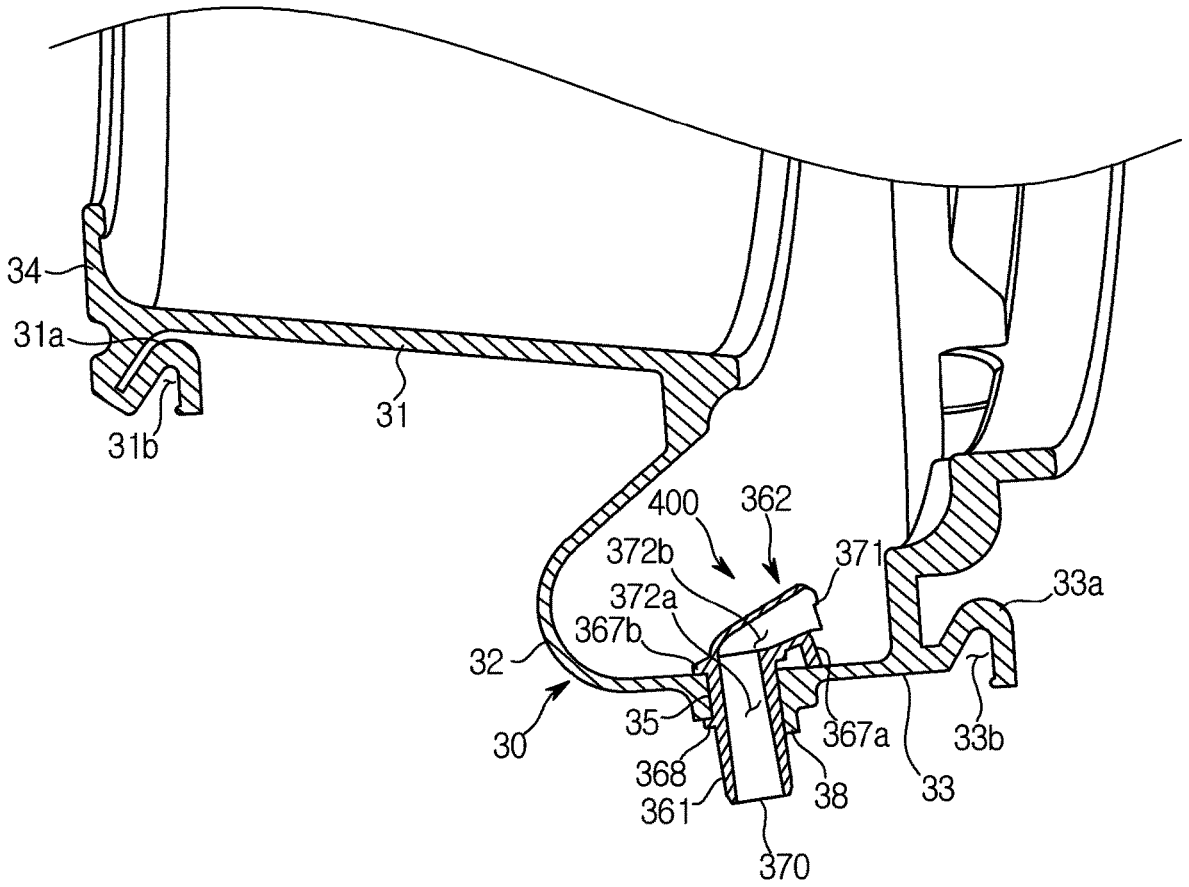
FIG. 14 is a cross-sectional view illustrating a detailed configuration of a diaphragm and a diaphragm cleaning nozzle of a washing machine according to an embodiment of the present disclosure.

FIG. 14 is a cross-sectional view illustrating a detailed configuration of a diaphragm and a diaphragm cleaning nozzle of a washing machine according to an embodiment of the present disclosure.

Referring to FIG. 14, the diaphragm 30 may include a front portion 31 that is provided relatively forward and is coupled to the inlet 12 of the main body 10, a rear portion 33 that is provided relatively rearward and coupled to the opening 21 of the tub 20, and the buffer portion 32 that connects the front portion 31 and the rear portion 33 and is bent at least once to function as a buffer.

A front engaging portion 31*a* may be formed at an end of the front portion 31 to be engaged with the inlet 12 of the main body 10, and a coupling ring mounting groove 31*b* may be formed at an outer side of the front engaging portion 31*a* to mount a coupling ring (not shown) for surrounding and fixing the main body 10 and the front engaging portion 31*a*. The front portion 31 may be provided with a door sealing portion 34 sealingly attached to the glass member 92 of the door 90.

A rear engaging portion 33*a* may be formed at an end of the rear portion 33 to be engaged with the opening 21 of the tub 20, and a coupling ring mounting groove 33*b* may be formed at an outer side of the rear engaging portion 33*a* to mount a coupling ring (not shown) for surrounding and fixing the tub 20 and the rear engaging portion 33*a*.

The door cleaning nozzle 19*b* and the cleaning reinforcing nozzle 19*c* described above are generally provided on the front portion 31 of the diaphragm 30, respectively, for the purpose of spraying washing water to the door 90 and the inside of the drum 40.

On the other hand, the diaphragm cleaning nozzle 400 may penetrate one surface of the buffer portion 32 to directly spray the washing water to the buffer portion 32. To this end, a coupling hole 35 may be formed on the buffer portion 32 so that the diaphragm cleaning nozzle 400 penetrates the coupling hole 35 and is fixed to the coupling hole 35. A boss portion 38 may be formed around the coupling hole 35 to support the diaphragm cleaning nozzle 400 penetrating the coupling hole 35.

The diaphragm cleaning nozzle 400 may include a coupling portion 361 that is mounted to penetrate the diaphragm 30 and a jet portion 362 that extends from the coupling portion 361 to guide the direction of the washing water.

The coupling portion 361 may have a substantially cylindrical shape, and may be coupled to the second water supply pipe 19. The jet portion 362 may have a fan shape so that the washing water to be sprayed spreads widely.

The diaphragm cleaning nozzle 400 may further include an inlet port 370 through which the washing water flows from the second water supply pipe 19, a jet port 371 through which the washing water is sprayed, and flow spaces 372*a* and 372*b* through which the inlet port 370 and the jet port 371 are connected.

The inlet port 370 may be formed in a substantially circular shape, and the jet port 371 may be formed in a substantially rectangular shape to spread the washing water widely.

The diaphragm cleaning nozzle 400 may have inner fixing portions 367*a* and 367*b* which are tightly supported to an inner side of the diaphragm 30 in the radial direction, and an outer fixing portion 368 which is tightly supported to an outer side of the diaphragm 30 in the radial direction. The outer fixing portion 368 may protrude from an outer circumferential surface of the coupling portion 361.

The diaphragm cleaning nozzle 400 may be provided on the buffer portion 32 of the diaphragm 30 corresponding to the rotating direction of the drum 40. Hereinafter, the position where the diaphragm cleaning nozzle 400 is provided will be described in detail with reference to FIGS. 15 and 16.

Figure 15:
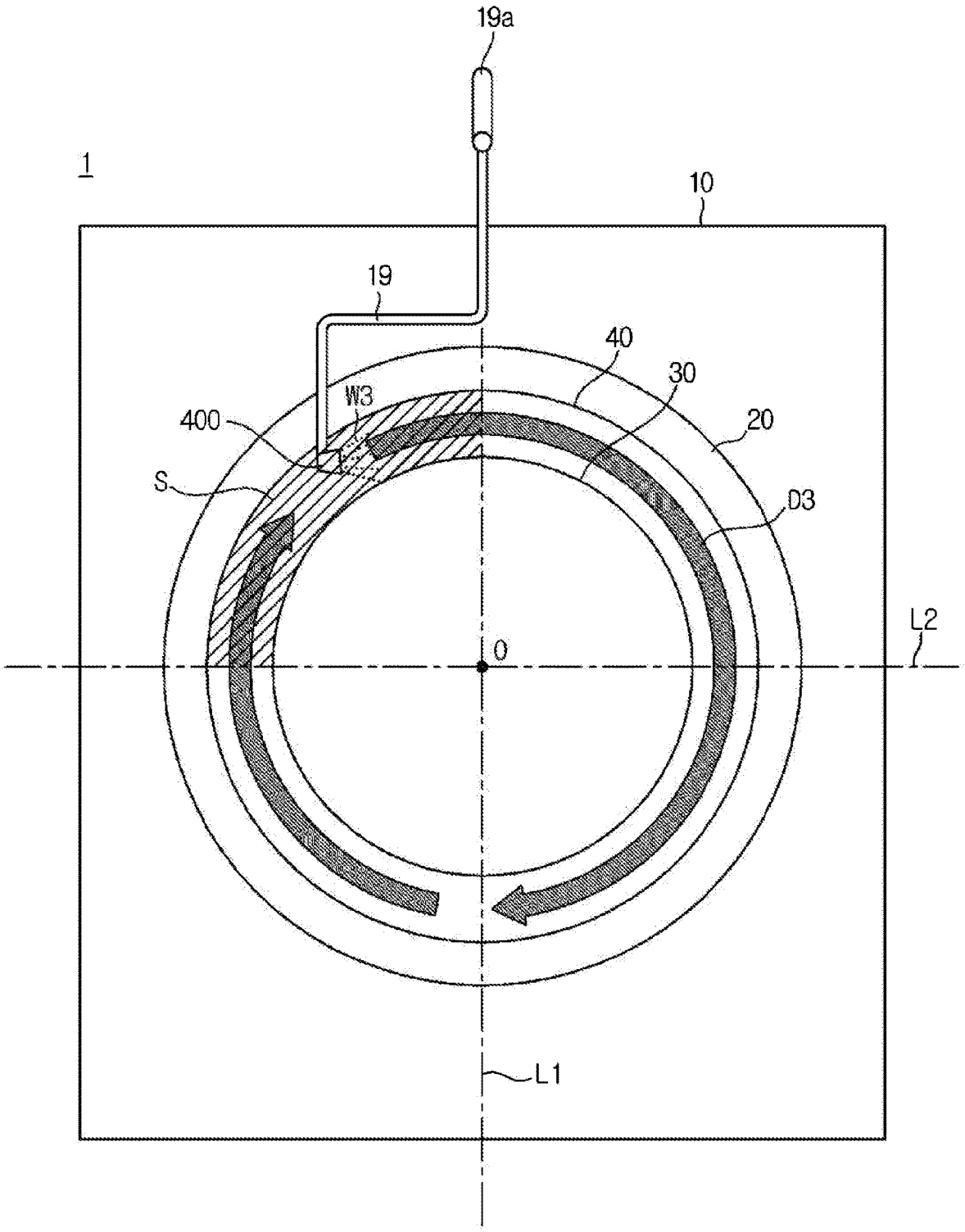
FIGS. 15 and 16 are views for explaining the position of a diaphragm cleaning nozzle according to an embodiment of the present disclosure.
Figure 16:
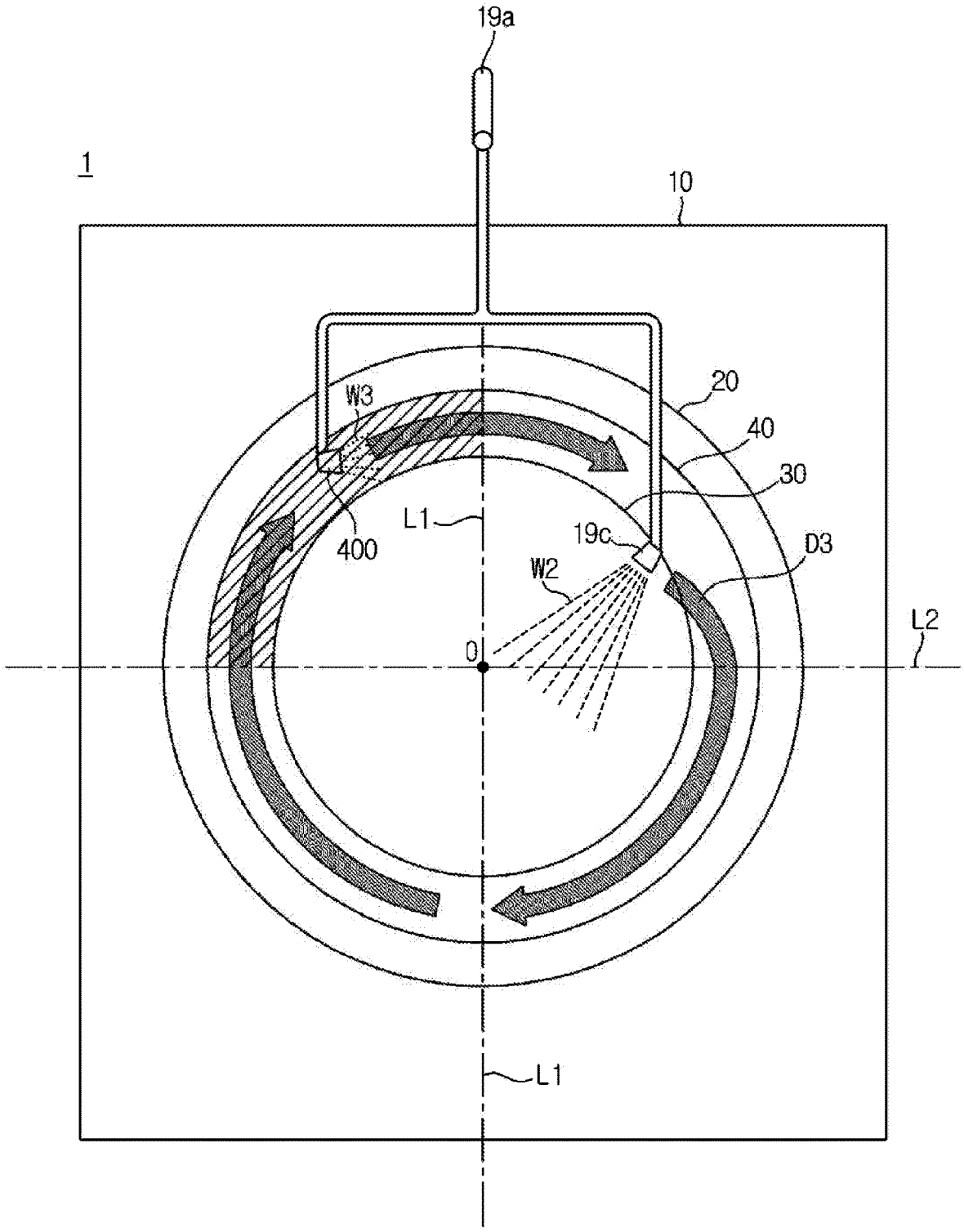

FIGS. 15 and 16 are views for explaining the position of a diaphragm cleaning nozzle according to an embodiment of the present disclosure. FIGS. 15 and 16 illustrate a case where when the washing machine 1 is viewed from the front, the tub 20, the drum 40, and the diaphragm 30 are concentric with each other with respect to a center O and have large diameters in that order. Also, FIG. 15 illustrates a case where the diaphragm cleaning nozzle 400 is provided on the diaphragm 30, and FIG. 16 illustrates a case where the diaphragm cleaning nozzle 400 and the cleaning reinforcing nozzle 19*c* are provided on the diaphragm 30. In FIGS. 15 and 16, it is assumed that the drum 40 rotates in the clockwise direction for convenience of explanation.

As described above, when the drum 40 rotates, the buffer portion 32 may be cleaned while the washing water rotates in the same direction as the rotating direction of the drum 40. Therefore, the diaphragm cleaning nozzle 400 may increase the cleaning efficiency by spraying the washing water in the rotating direction of the drum 40.

At this time, the diaphragm cleaning nozzle 400 may be installed at a position on the diaphragm 30 corresponding to an position in the rotating direction of the drum 40. Specifically, when the drum 40 rotates clockwise, the diaphragm cleaning nozzle 400 may be installed on an upper left side of the diaphragm 30, and when the drum 40 rotates counterclockwise, the diaphragm cleaning nozzle 400 may be installed on an upper right side of the diaphragm 30.

Referring to FIG. 15, the positions on the diaphragm 30 may be distinguished by a first reference line L1 passing through the center O of the concentric circle and perpendicular to the bottom surface and a second reference line L2 passing through the center O of the concentric circle and perpendicular to the first reference line L1. Specifically, the area of the diaphragm 30, which is on the upper side with respect to the second reference line L2 and on the left side with respect to the first reference line L1, is defined as an upper left region of the diaphragm 30, and the area of the diaphragm 30, which is on the upper side with respect to the second reference line L2 and on the right side with respect to the first reference line L1, is defined as an upper right region of the diaphragm 30.

When the drum 40 rotates in the clockwise direction and the diaphragm cleaning nozzle 400 for spraying the washing water in the clockwise direction is located at an upper center (on the first reference line L1), the upper left region (hatched region in FIGS. 15 and 16) of the diaphragm 30 may be vulnerable to cleaning. The washing water sprayed from the upper center proceeds in the direction opposite to gravity while passing through a lower center, so that it may be difficult for the washing water to reach the upper left region.

On the other hand, as illustrated in FIG. 15, when the diaphragm cleaning nozzle 400 is installed on the upper left region of the diaphragm 30, the washing water preferentially passes through the upper left region, so that the cleaning of the corresponding region may be performed. At this time, the door 90 may also be cleaned together.

FIG. 15 illustrates the case where only the diaphragm cleaning nozzle 400 is provided on the diaphragm 30, but it is also possible that the diaphragm cleaning nozzle 400 and the cleaning reinforcing nozzle 19*c* are provided together on the diaphragm 30 as illustrated in FIG. 16. It is also possible to provide the door cleaning nozzle 19*b* on the diaphragm 30 as well. Through this, the ability of cleaning the diaphragm 30 may be enhanced.

As described above, by additionally providing the diaphragm cleaning nozzle 400 at a position corresponding to the rotation direction of the drum 40, the efficiency of cleaning the diaphragm 30 may be maximized.

Figure 17:
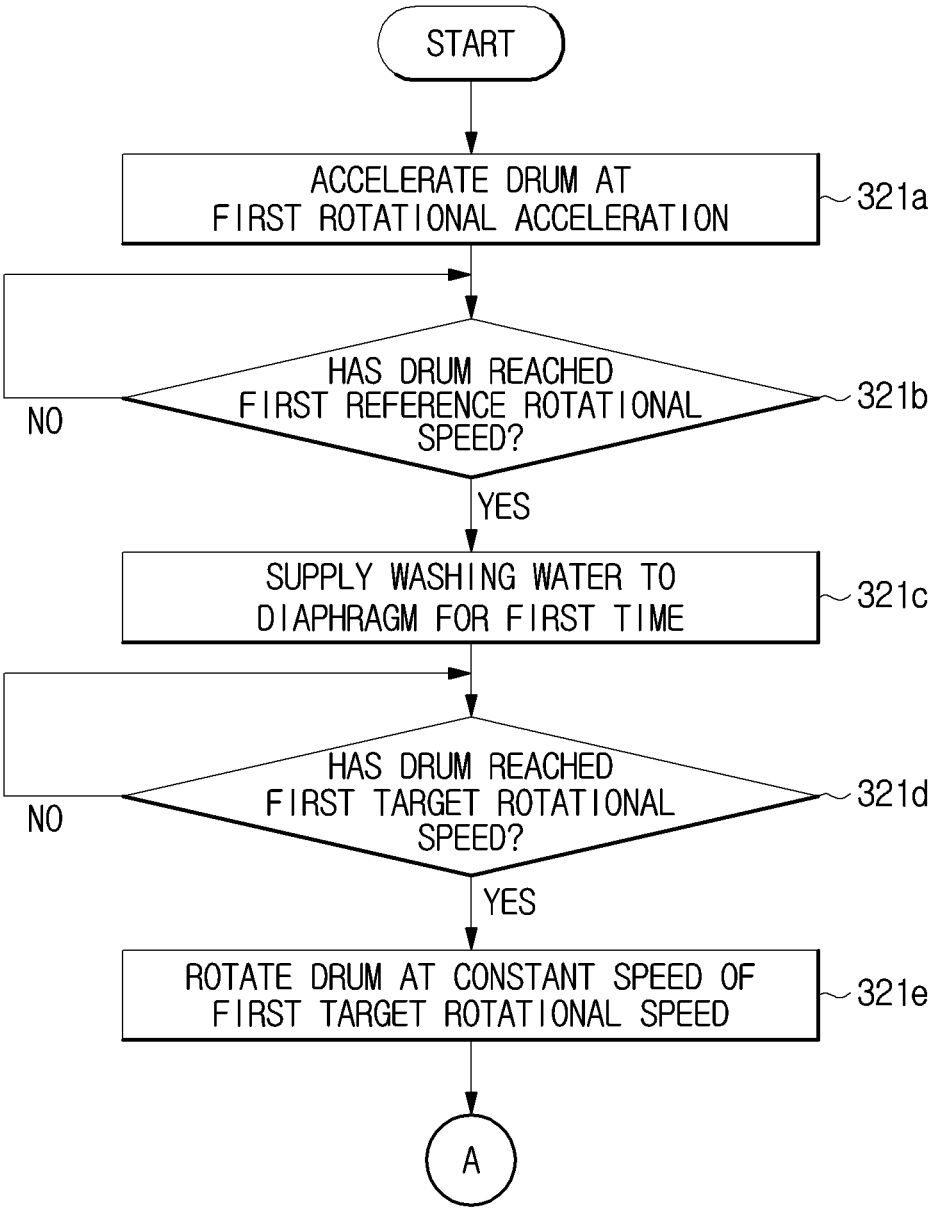
FIGS. 17 and 18 are flowcharts specifically illustrating a cleaning process of a diaphragm in a control method of a washing machine according to an embodiment of the present disclosure.
Figure 18:
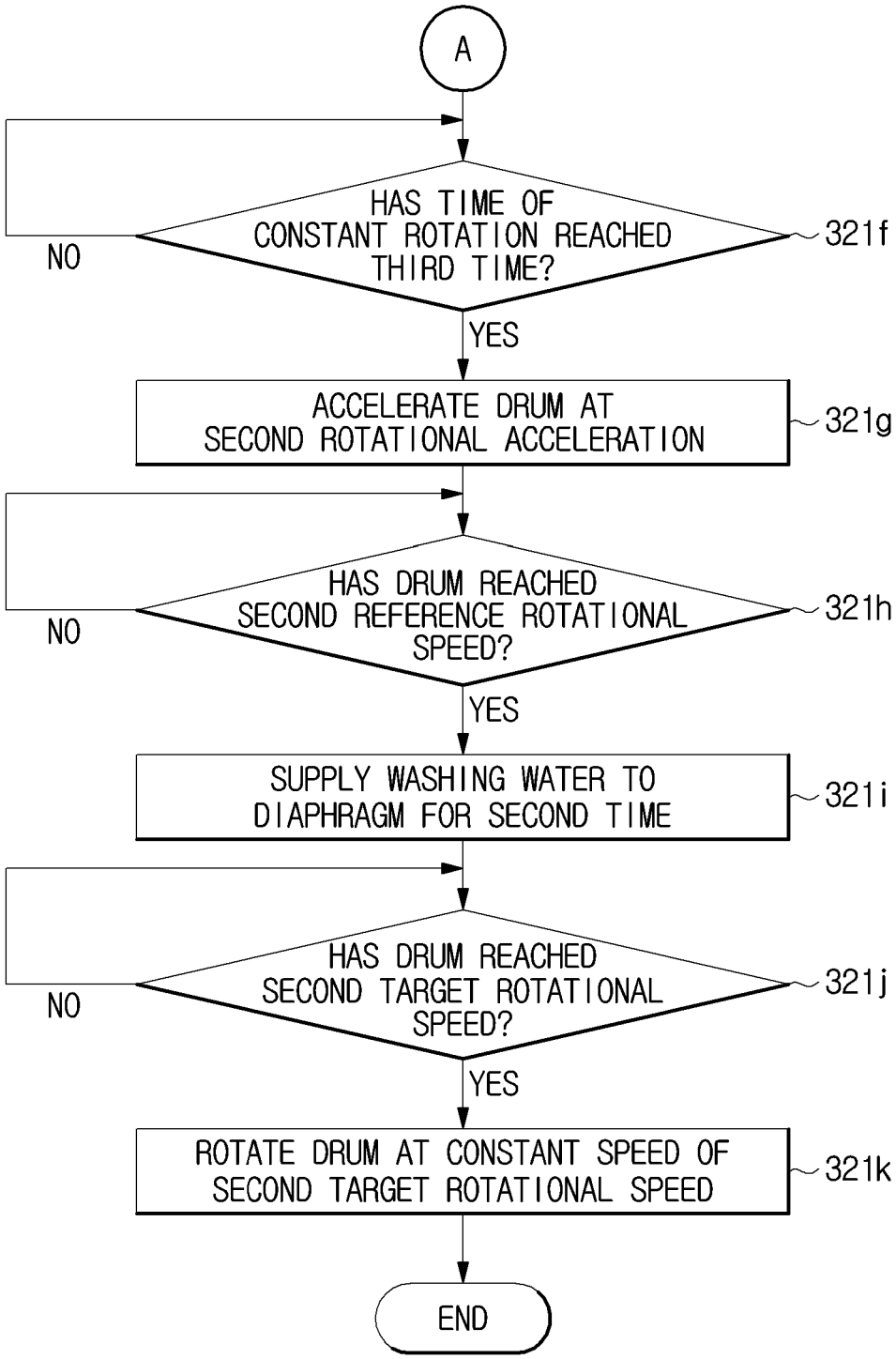

FIGS. 17 and 18 are flowcharts specifically illustrating a cleaning process of a diaphragm in a control method of a washing machine according to an embodiment of the present disclosure.

Referring to FIGS. 17 and 18, the controller 110 may rotate the drum 40 at a first rotational acceleration (321*a*). Specifically, the controller 110 may rotate the drum 40 at the first rotational acceleration so as to reach a first target rotational speed on the premise that the diaphragm cleaning process has entered a first section during a contaminant discharge mode.

While accelerating the drum 40, the controller 110 may confirm whether the drum 40 has reached a first reference rotational speed (321*b*). Herein, the first reference rotational speed may refer to the rotational speed of the drum 40 having an optimum cleaning efficiency of the diaphragm 30 in the first section. If the drum 40 has not yet reached the first reference rotational speed (NO in 321*b*), the controller 110 may repeatedly confirm whether the drum 40 has reached the first reference rotational speed.

If the drum 40 has reached the first reference rotational speed (YES in 321*b*), the controller 110 may supply the washing water to the diaphragm 30 for a first time (321*c*). For example, if the first reference rotational speed is 300 RPM and the first time is 5 seconds, the controller 110 may supply the washing water to the diaphragm 30 for 5 seconds from the instant when the drum 40 accelerated at the first rotational acceleration reaches 300 RPM.

In order to supply the washing water to the diaphragm 30, the washing machine 1 may use at least one of the door cleaning nozzle 19*b* for spraying washing water toward the door 90, the cleaning reinforcing nozzle 19*c* for spraying washing water toward the drum 40, and the diaphragm cleaning nozzle 400 for supplying washing water to the buffer portion 32 of the diaphragm 30. The door 90 and the diaphragm 30 may be cleaned together depending on the nozzles to be used.

Then, the controller 110 may confirm whether the drum 40 has reached the first target rotational speed (321*d*). If the drum 40 has not yet reached the first target rotational speed (NO in 321*d*), the controller 110 may repeatedly confirm whether the drum 40 has reached the first target rotational speed.

If the drum 40 has reached the first target rotational speed (YES in 321*d*), the controller 110 may rotate the drum 40 at a constant speed of the first target rotational speed (321*e*). Since the fact that the drum 40 has reached the first target rotational speed means that the first section of the diaphragm cleaning process is terminated, the controller 110 may rotate the drum 40 at a constant speed until the diaphragm cleaning process enters a second section.

While rotating the drum 40 at a constant speed, the controller 110 may confirm whether the time of the constant rotation has reached a third time (321*f*). The third time may refer to a minimum time for entering the second section after the termination of the first section. If the time of the constant rotation has not reached the third time (NO in 321*f*), the controller 110 may repeatedly confirm whether the time of constant rotation has reached the third time.

If the time of the constant rotation has reached the third time (YES in 321*f*), the controller 110 may accelerate the drum 40 at a second rotational acceleration (321*g*). Specifically, the controller 110 may accelerate the drum 40 at the second rotational acceleration so as to reach the second target rotational speed on the premise that the diaphragm cleaning process has entered the second section.

While accelerating the drum 40, the controller 110 may confirm whether the drum 40 has reached a second reference rotational speed (321*h*). Herein, the second reference rotational speed may refer to the rotational speed of the drum 40 having an optimum cleaning efficiency of the diaphragm 30 in the second section. If the drum 40 has not yet reached the second reference rotational speed (NO in 321*h*), the controller 110 may repeatedly confirm whether the drum 40 has reached the second reference rotational speed.

If the drum 40 has reached the second reference rotational speed (YES in 321*h*), the controller 110 may supply the washing water to the diaphragm 30 for a second time (3211). For example, if the second reference rotational speed is 1050 RPM and the second time is 5 seconds, the controller 110 may supply the washing water to the diaphragm 30 for 5 seconds from the instant when the drum 40 accelerated by the second rotational acceleration reaches 1050 RPM.

In order to supply the washing water to the diaphragm 30, the washing machine 1 may use at least one of the door cleaning nozzle 19*b* for spraying washing water toward the door 90, the cleaning reinforcing nozzle 19*c* for spraying washing water toward the drum 40, and the diaphragm cleaning nozzle 400 for supplying washing water to the buffer portion 32 of the diaphragm 30.

Then, the controller 110 may confirm whether the drum 40 has reached the second target rotational speed (321*j*). If the drum 40 has not yet reached the second target rotational speed (NO in 321*j*), the controller 110 may repeatedly confirm whether the drum 40 has reached the second target rotational speed.

On the other hand, if the drum 40 has reached the second target rotational speed (YES in 321*j*), the controller 110 may rotate the drum 40 at the second target rotational speed of a constant speed (321*k*). Since the fact that the drum 40 has reached the second target rotational speed means that the second section of the diaphragm cleaning process is terminated, the controller 110 may terminate the diaphragm cleaning process.

The above-described diaphragm cleaning process according to FIGS. 17 and 18 is merely an example of a method for cleaning and discharging contaminants separated through the waterless process with water in a washing machine and a control method thereof according to an embodiment of the present disclosure, and embodiments of a washing machine and a control method thereof are not limited thereto.

Figure 19:
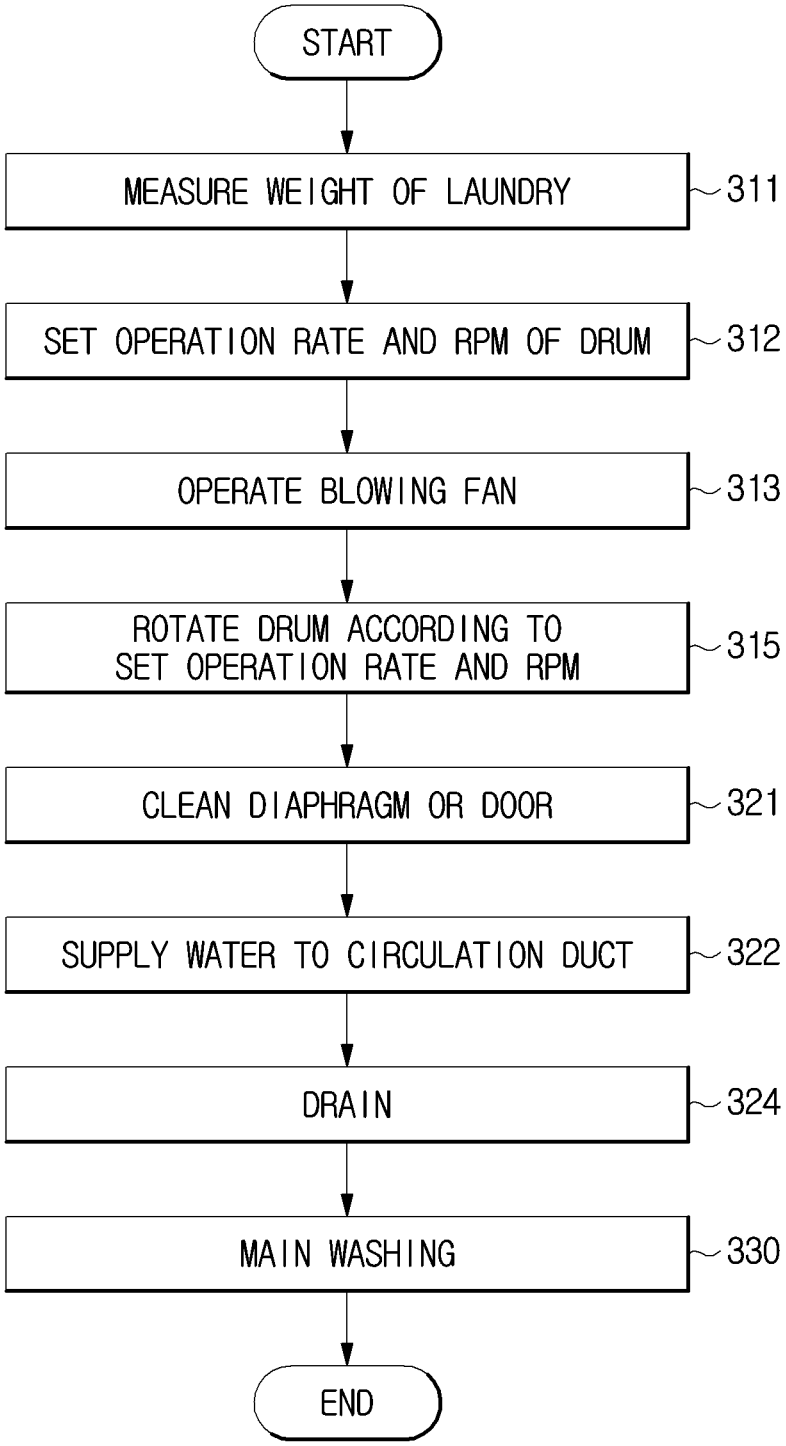
FIG. 19 is another flowchart illustrating the operation of separating contaminants from laundry and discharging the separated contaminants in a control method of a washing machine according to an embodiment of the present disclosure.

FIG. 19 is another flowchart illustrating the operation of separating contaminants from laundry and discharging the separated contaminants in a control method of a washing machine according to an embodiment of the present disclosure.

As described above, in order to separate contaminants from the laundry, the controller 110 may operate the blowing fan 66 to blow the air inside the drum 40 (313). At this time, the air flowing into the circulation duct 62 from the inside of the drum 40 may contain contaminants such as fine dust, and thus as illustrated in FIG. 19, the controller 110 may wash the contaminants introduced into the circulation duct 62 by supplying water to the circulation duct 62 through the condensation water supply pipe 69 (322). To this end, the controller 110 may control the second water supply valve 19*a* so that the washing water is sprayed through the water supply nozzle 63, and the sprayed washing water flows down along the inner surface of the circulation duct 62 and may wash out contaminants present in the circulation duct 62. Further, when a filter is provided in the circulation duct 62, the washing water supplied to the circulation duct 62 may also clean the filter.

The washing water from which the contaminants have been washed is drained through a drain pipe connected to the drain hose 56 (324).

In addition, the cleaning (321) of the diaphragm 30 or the door 90 described above may also be performed for the discharge of the separated contaminants.

According to another example of a washing machine 1, even when a separate circulation duct for drying laundry is not provided, the washing water may be supplied to the rear surface of the tub 20 to remove moisture generated by the drying of the laundry. Hereinafter, a description will be given with reference to FIGS. 20 and 21.

Figure 20:
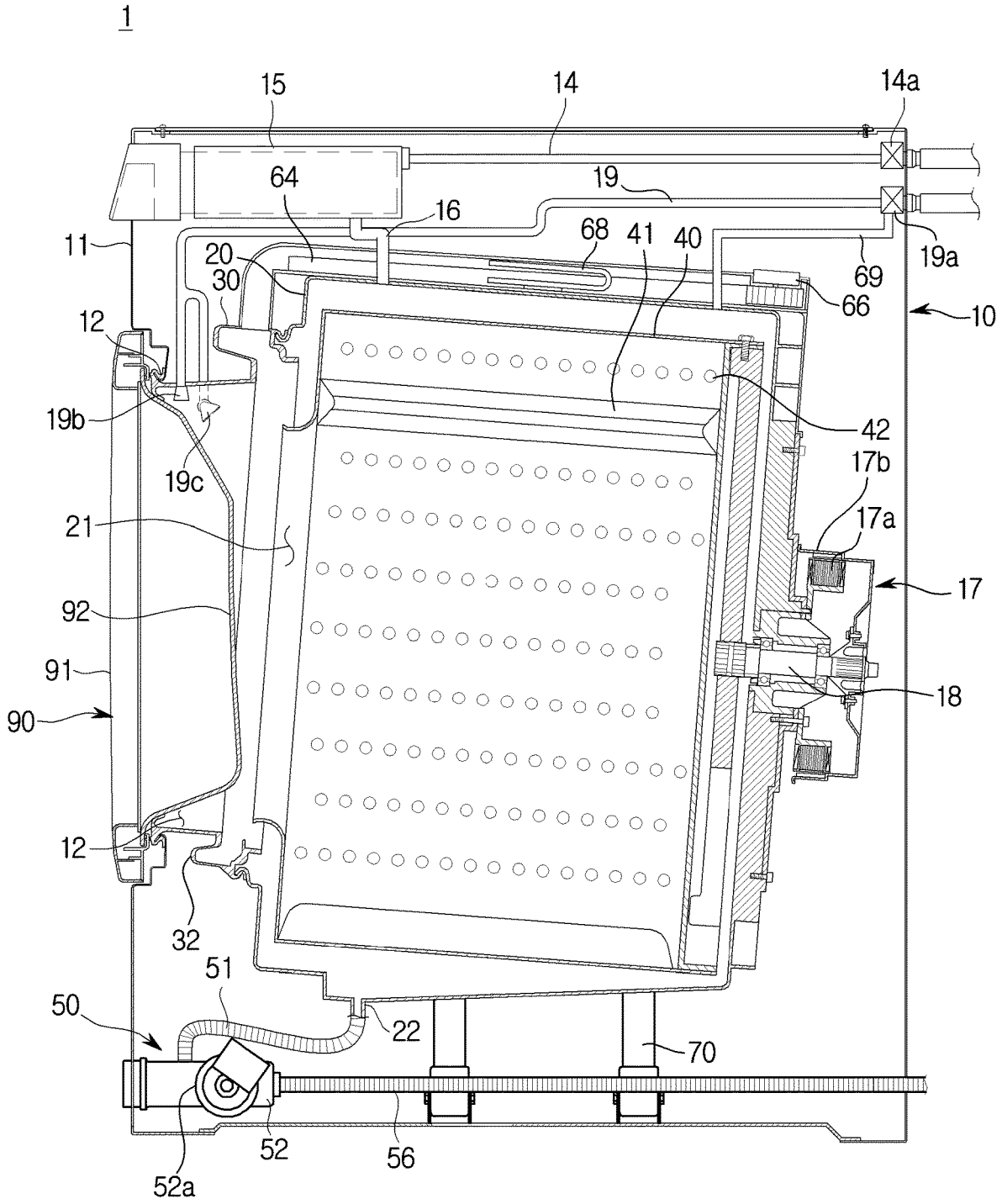
FIG. 20 is another side cross-sectional view of a washing machine according to an embodiment of the present disclosure.
Figure 21:
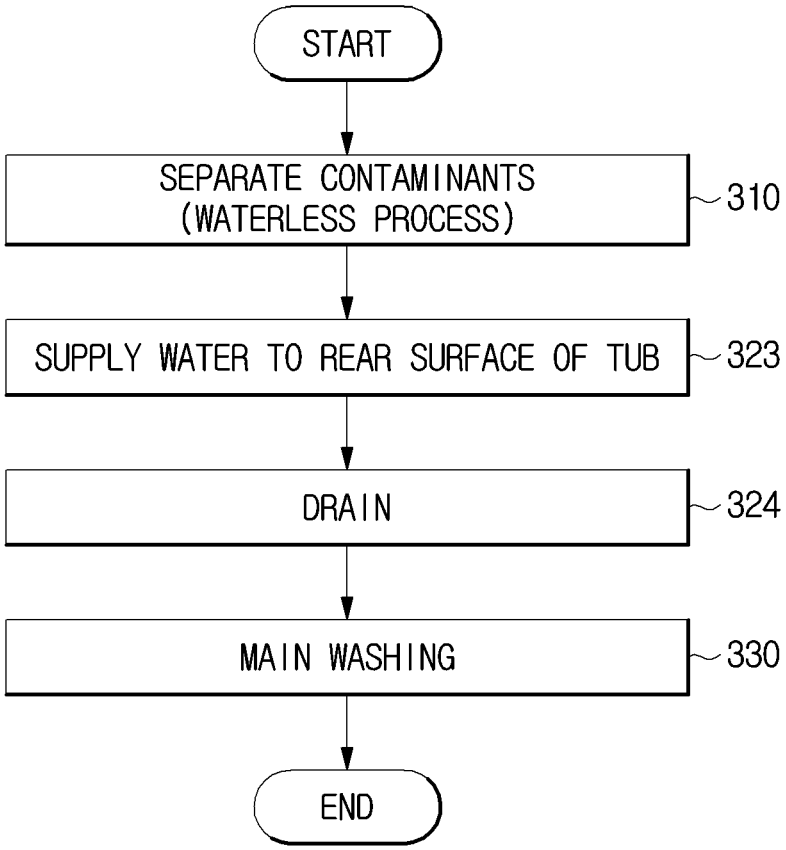
FIG. 21 is another flowchart illustrating the operation of discharging separated contaminants in a control method of a washing machine according to an embodiment of the present disclosure.

FIG. 20 is another side cross-sectional view of a washing machine according to an embodiment of the present disclosure, and FIG. 21 is another flowchart illustrating the operation of discharging separated contaminants in a control method of a washing machine according to an embodiment of the present disclosure.

Referring to FIG. 20, in another example of the washing machine 1, the condensation water supply pipe 69 may be connected to a rear upper side of the tub 20. The washing water supplied through the condensation water supply pipe 69 may flow into a space between the tub 20 and the drum 40. Specifically, the washing water flows down along the inner wall of the rear surface of the tub 20, so that contaminants existing between the tub 20 and the drum 40 may be washed away.

The washing water supplied to the rear surface of the tub 20 may pass through the space between the tub 20 and the drum 40, and may be introduced into the pump chamber 52 through the drain port 22.

The drying device 60 may be provided with a filter (not shown) for collecting contaminants contained in the air introduced from the drum 40. In this case, the washing water supplied through the condensation water supply pipe 69 may also wash the contaminants collected in the filter by passing through the filter.

Referring to FIG. 21, when the contaminant separation (310) through the waterless process, which is previously described, is completed, the washing water is supplied to the rear surface of the tub 20 through the condensation water supply pipe 69 (323). When the door cleaning nozzle 19*b*, the cleaning reinforcing nozzle 19*c*, or the diaphragm cleaning nozzle 400 are provided in the washing machine 1, cleaning of the door 90 or the diaphragm 30 may also be performed.

Alternatively, the contaminant separation process and the supply of the washing water to the rear surface of the tub 20 may be performed at the same time. In this case, the washing water supplied to the inside of the tub 20 may be introduced into the drum 40. Accordingly, the controller 110 may increase the rotational speed of the drum 40 by a predetermined speed or higher (for example, about 80 RPM or higher) before water is supplied into the tub 20 to rotate the drum 40 at a high speed. When the drum 40 rotates at a high speed, the washing water supplied to the inside of the tub 20 may be scattered from the surface of the drum 40 by the rotation of the drum 40 and flow into the space between the tub 20 and the drum 40. Thereby, the amount of water introduced into the drum 40 may be minimized.

When the condensation water supply pipe 69 passes through a filter, the washing water supplied through the condensation water supply pipe 69 may also wash the contaminants collected in the filter.

The supply of washing water to the inside of the tub 20 may be performed for a set time. The washing water supply time may be set by the controller 110 based on the water level of the tub 20 or may be set by the user or may be set to a default value or may be set by the controller 110 according to the weight of the laundry or the amount of dust. The water level of the tub 20 may be measured by a water level sensor that senses the water level of the water stored in the tub 20.

When the set time has elapsed, the controller 110 may operate the drain pump 52*a* to drain the washing water.

According to this example, even when no circulation duct is separately provided in the washing machine 1, or even when a separate nozzle for cleaning the door 90 or the diaphragm 30 is not provided, the contaminants separated from the laundry may be washed out and discharged to the outside.

Figure 22:
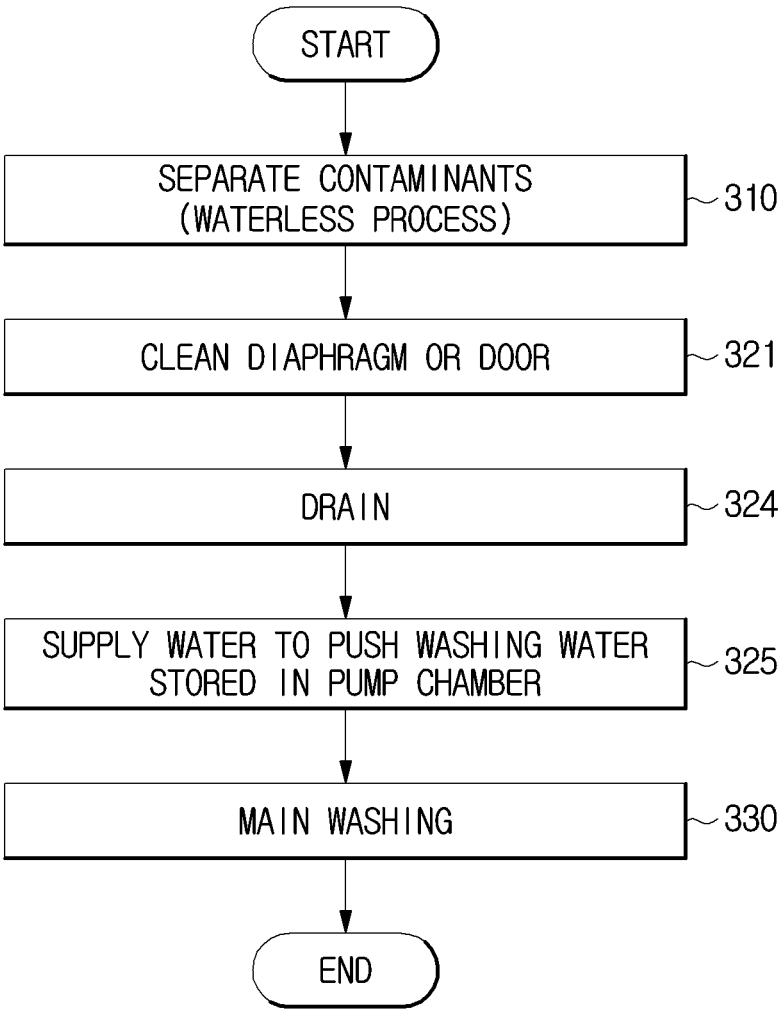
FIG. 22 is another flowchart illustrating the operation of separating contaminants from laundry and discharging the separated contaminants in a control method of a washing machine according to an embodiment of the present disclosure.

FIG. 22 is another flowchart illustrating the operation of separating contaminants from laundry and discharging the separated contaminants in a control method of a washing machine according to an embodiment of the present disclosure.

As described above, the contaminants are separated (310) from the laundry through the waterless process, and the diaphragm 30 or the door 90 is cleaned (321) by the washing water, and then the washing water is drained (324) so that the separated contaminants may be discharged. Alternatively, it is possible to supply water to the rear surface of the tub 20 together with the cleaning of the diaphragm 30 or the door 90, or it is also possible to omit the cleaning of the diaphragm 30 or the door 90 and to supply water to the rear surface of the tub 20.

The washing water used for cleaning is guided to the pump chamber 52, and the drain pump 52*a* pumps the stored washing water and discharges the washing water through the drain hose 56 to the outside. At this time, a part of the washing water stored in the pump chamber 52 may remain. Accordingly, the main washing process may be performed (330) after the water supply for pushing the washing water stored in the pump chamber 52 is additionally performed (325). Specifically, the controller 110 controls the second water supply valve 19*a* to additionally supply washing water, and the supplied washing water is guided to the pump chamber 52, and thus the contaminated washing water remaining in the pump chamber 52 may be pushed out to the drain hose 56 by the washing water guided to the pump chamber 52. Thereby, it is possible to prevent the washing water containing contaminants from mixing with the washing water used in the main washing process.

Figure 23:
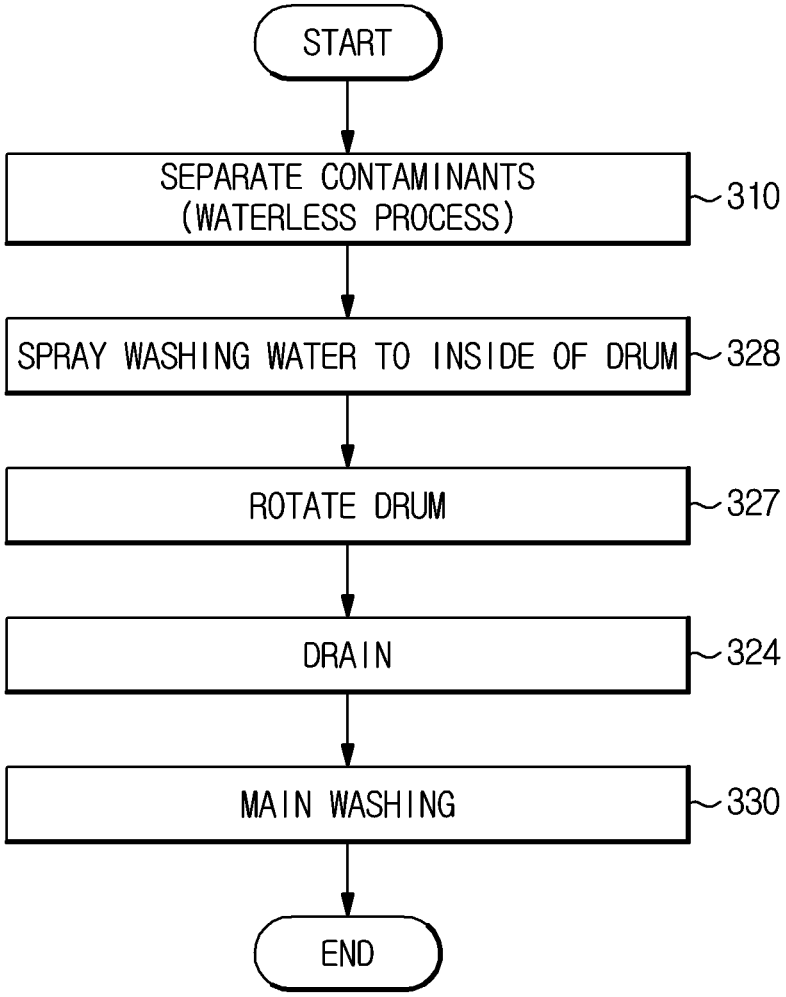
FIG. 23 is another flowchart illustrating the operation of separating contaminants from laundry and discharging the separated contaminants in a control method of a washing machine according to an embodiment of the present disclosure.
Figure 24:
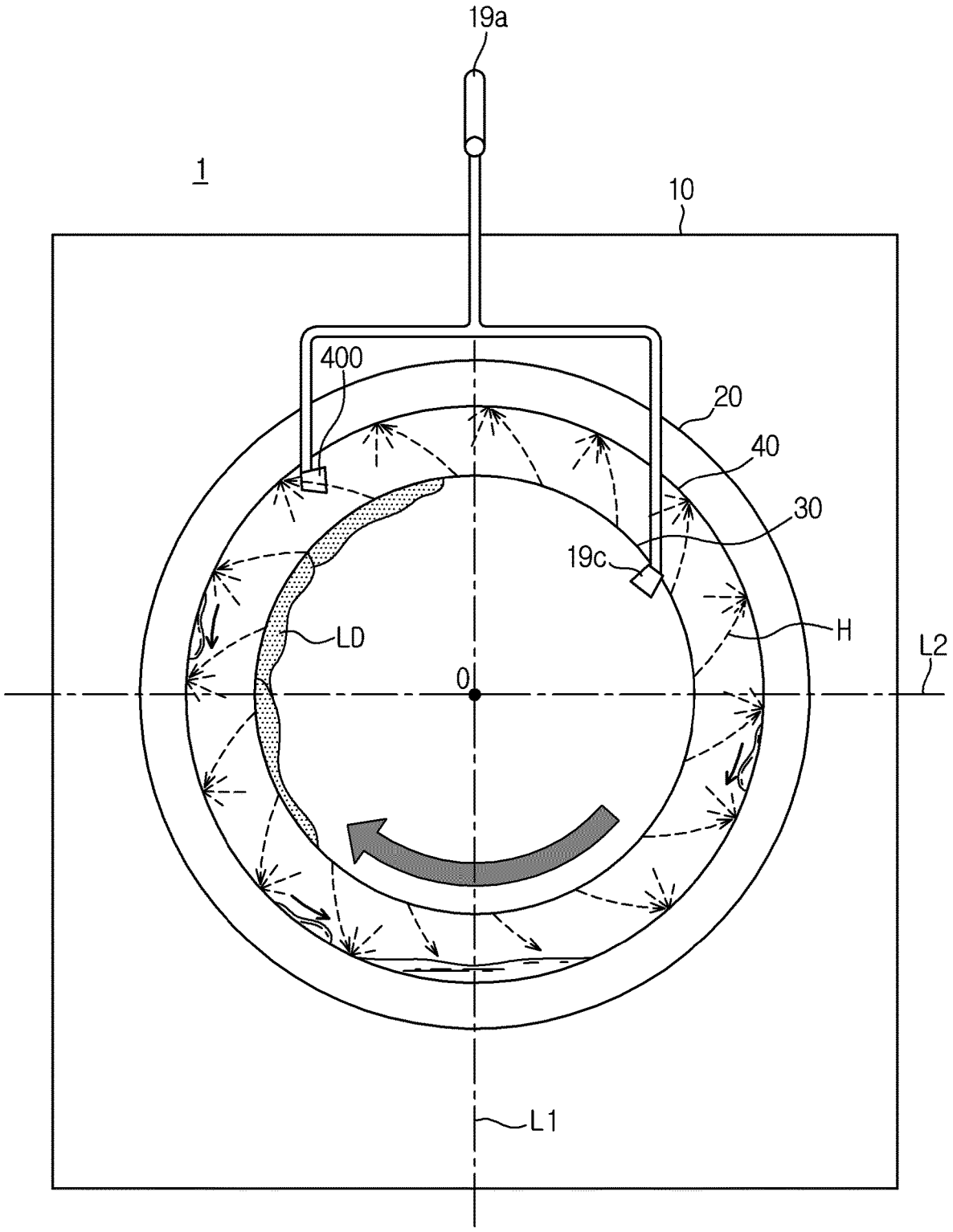
FIG. 24 is a view for explaining the contaminant discharge operation of FIG. 23.
Figure 25:
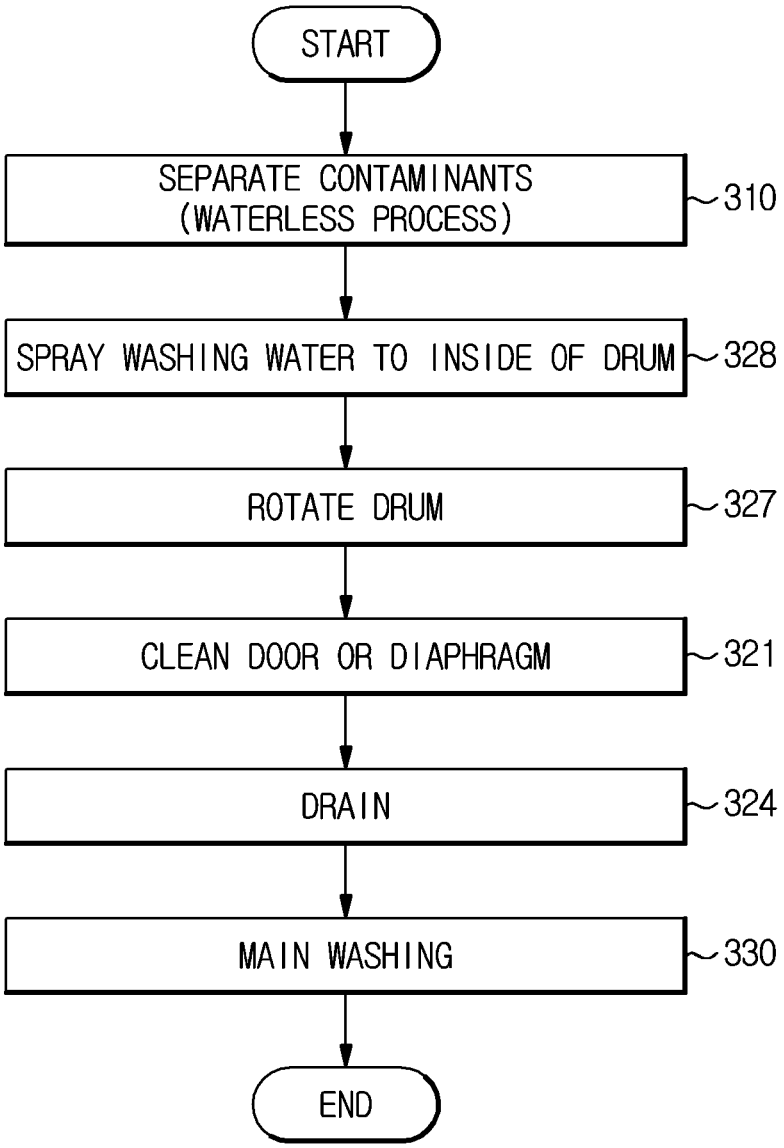
FIG. 25 is another flowchart illustrating the operation of separating contaminants from laundry and discharging the separated contaminants in a control method of a washing machine according to an embodiment of the present disclosure.

FIGS. 23 and 25 are other flowcharts illustrating the operation of separating contaminants from laundry and discharging the separated contaminants in a control method of a washing machine according to an embodiment of the present disclosure, and FIG. 24 is a view for explaining the contaminant discharge operation of FIG. 23.

Referring to FIG. 23, the contaminant separation through the waterless process is performed (310), the washing water is sprayed (328) into the drum 40 to discharge the separated contaminants, and the drum 40 may be rotated (327). Herein, the explanation of the contaminant separation through the waterless process is the same as that described above.

The washing water may be sprayed into the drum 40 through the cleaning reinforcing nozzle 19*c*. The controller 110 may directly control the cleaning reinforcing nozzle 19*c* or may control the second water supply valve 19*a* of the second water supply pipe 19 to spray the washing water through the cleaning reinforcing nozzle 19*c*.

Also, the washing water may be sprayed into the drum 40 through the door cleaning nozzle 19*b* or the diaphragm cleaning nozzle 400. That is, in this embodiment, the washing water needs only to be sprayed into the drum 40, and there is no limitation on the kind of the nozzle for spraying the washing water.

Spraying of the washing water into the drum 40 may be performed for a predetermined time. The washing water spraying time may be set by the controller 110 according to the weight of the laundry or the amount of dust sensed, may be preset to a default value, or may be set by the user. Alternatively, when the water level of the tub 20 reaches a predetermined reference value, the controller 110 may terminate the spraying of the washing water into the drum 40.

When the spraying of the washing water into the drum 40 is terminated or when the water level of the tub 20 reaches a predetermined reference value, the controller 110 may operate the drain pump 52*a* to drain the residual water in the tub 20. Thereby, the residual water in the tub 20 may be prevented from flowing into the drum 40.

When the spraying of the washing water into the drum 40 and the drainage of the residual water are completed, the controller 110 rotates the drum 40 (327). For example, the controller 110 may rotate the drum 40 at a high speed in one direction as in the dehydrating process. At this time, the rotational speed of the drum 40 may be set to a predetermined default value, or may be determined by the controller 110 according to the weight of the laundry or the sensed dust amount, or may be set by user input. The RPM of the drum 40 may be set to be greater than the RPM in the contaminant separation process, and as an example, an RPM in the range of 500 to 900 RPM may be set to the RPM of the drum 40.

Referring to FIG. 24, as washing water H is sprayed into the drum 40, laundry LD is wetted, and when a centrifugal force is generated by quickly rotating the drum 40 in the state where the laundry LD is wet, the moisture contained in the laundry LD may be removed. The moisture or the washing water H ejected from the laundry LD by the centrifugal force is introduced into the space between the drum 40 and the tub 20 through the through holes 42 formed in the drum 40, and the space between the drum 40 and the tub 20 is cleaned by the introduced moisture or the washing water H, so that the contaminants separated from the laundry may be washed away.

The rotation time of the drum 40 may also be set to a predetermined default value, or may be determined by the controller 110 according to the weight of the laundry or the sensed dust amount, or may be set by user input. For example, the drum 40 may be rotated for 6 minutes at a speed of 900 RPM to clean the space between the drum 40 and the tub 20 using the washing water ejected from the laundry.

When the rotation of the drum 40 is completed, the controller 110 may operate the drain pump 52*a* to drain the residual water in the tub 20 again (324). Alternatively, it is also possible to simultaneously perform the rotation of the drum 40 and the drainage for removing moisture from the laundry. When the drainage is completed, the main washing process is performed (330).

Alternatively, as illustrated in FIG. 25, it is also possible to clean the door 90 or the diaphragm 30 (321) before draining the residual water in the tub 20. For example, when the rotational speed of the drum 40 reaches a predetermined RPM, the controller 110 may clean the door 90 or the diaphragm 30 by spraying the washing water through at least one of the door cleaning nozzle 19*b*, the cleaning reinforcing nozzle 19*c*, and the diaphragm cleaning nozzle 400. The explanation of the cleaning of the door 90 or the diaphragm 30 is the same as the above-mentioned description.

The cleaning time of the door 90 or the diaphragm 30 may also be set to a predetermined default value, or may be determined by the controller 110 according to the weight of the laundry or the sensed dust amount, or may be set by user input. When the predetermined time has elapsed or the water level of the tub 20 reaches the reference value, the controller 110 may control the drain pump 52*a* to drain the residual water in the tub 20 (324).

According to the embodiments of the washing machine and the control method thereof as described above, the separated contaminants can be prevented from contaminating the laundry again in the main washing process and effective washing can be performed by separating the contaminants from the laundry through the waterless process before performing the main washing process, washing and discharging the separated contaminants to the outside, and then performing the main washing process.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a main body provided with an inlet at a front portion of the main body;

a door provided to open and close the inlet;

a tub having an opening corresponding to the inlet and provided inside the main body;

a drum, rotatably provided inside the tub, in which laundry received through the inlet is accomodatable;

a door cleaning nozzle aimed directly at the door to spray washing water toward the door;

a pump chamber provided at a lower portion of the tub to store washing water discharged from the tub;

a drain pump provided to pump washing water stored in the pump chamber to thereby be discharged to outside the washing machine;

a detergent supply device; and a controller configured to perform control to:

before main washing of laundry accommodated in the drum is performed, rotate the drum in a waterless process to tumble the laundry accommodated in the drum, to thereby separate contaminants from the laundry, before the main washing of the laundry accommodated in the drum is performed, spray washing water by the door cleaning nozzle toward the door to clean the door of contaminants separated from the laundry by the waterless process, wherein the sprayed washing water is discharged from the tub to the pump chamber to thereby be stored in the pump chamber, operate the drain pump to discharge the washing water stored in the pump chamber, and after operating the drain pump to discharge the washing water, supply additional washing water that passes through the detergent supply device, to the tub, to perform the main washing of the laundry accommodated in the drum.

2. The washing machine according to claim 1, further comprising:

a circulation duct provided to introduce air into the drum;

a drying duct provided to discharge air into the drum; and a blowing fan provided to form a flow of air between the circulation duct and the drying duct, wherein the controller is configured to perform control to operate the blowing fan to supply air into the drum while the drum rotates in the waterless process.

3. The washing machine according to claim 2, further comprising:

a heater provided to heat the air discharged into the drum, wherein the controller is configured to perform control to control the heater to supply hot air to an inside of the drum when the blowing fan operates in the waterless process.

4. The washing machine according to claim 1, further comprising:

a diaphragm provided to connect the inlet of the main body and the opening of the tub, wherein the controller is configured to, in order to clean the diaphragm of contaminants separated from the laundry by the waterless process while the washing water is being sprayed toward the door by the door cleaning nozzle, perform control to rotate the drum at a preset speed and spray washing water by the door cleaning nozzle for a preset time at a preset point.

5. The washing machine according to claim 4, further comprising:

a cleaning reinforcing nozzle provided on the diaphragm to spray washing water toward an inside of the drum, wherein the controller is configured to, before the main washing of the laundry accommodated in the drum is performed, perform control to spray the washing water through the cleaning reinforcing nozzle to dean the diaphragm of contaminants separated from the laundry by the waterless process.

6. The washing machine according to claim 4, further comprising:

a diaphragm cleaning nozzle provided at a position corresponding to a rotation direction of the drum on a buffer portion, which is a region where the diaphragm is bent, to spray washing water to the diaphragm, wherein the controller is configured to perform control to spray washing water by the diaphragm cleaning nozzle in the rotating direction of the drum when the washing water is sprayed by the door cleaning nozzle, to clean the diaphragm of contaminants separated from the laundry by the waterless process.

7. The washing machine according to claim 2, wherein the controller is configured to perform control to supply washing water to the circulation duct before supplying the additional washing water that passes through the detergent supply device, to clean the circulation duct of contaminants separated from the laundry by the waterless process.

8. The washing machine according to claim 1, further comprising:

a water supply pipe provided to be connected to a rear upper side of the tub, wherein the controller is configured to perform control to supply washing water to the water supply pipe connected to the rear upper side of the tub to supply washing water to a rear surface of the tub before supplying the additional washing water that passes through the detergent supply device, to clean the rear surface of the tub of contaminants separated from the laundry by the waterless process.

9. The washing machine according to claim 1, wherein the controller is configured to perform control to, after operating the drain pump to discharge the washing water stored in the pump chamber, and before supplying the additional washing water that passes through the detergent supply device, supply washing water to the pump chamber to push remaining washing water stored in the pump chamber.

10. The washing machine according to claim 1, wherein the controller is configured to perform control to set a rotational speed (RPM) and an operation rate of the drum in the waterless process based on weight of laundry accommodated in the tub.

11. A washing machine comprising:

a tub provided inside a main body;

a drum rotatably provided inside the tub and in which laundry is accommodatable;

at least one nozzle provided to spray washing water to an inside of the drum;

a pump chamber provided at a lower portion of the tub to store washing water discharged from the tub;

a drain pump provided to pump washing water stored in the pump chamber to thereby be discharged to outside the washing machine;

a detergent supply device; and a controller configured to perform control to:

before main washing of laundry accommodated in the drum is performed, rotate the drum in a waterless process to separate contaminants from the laundry accommodated in the drum, before the main washing of the laundry accommodated in the drum is performed, spray washing water to the inside of the drum by the at least one nozzle to clean the inside of the drum of contaminants separated from the laundry by the waterless process, after spraying the washing water to the inside of the drum, rotate the drum in one direction to discharge washing water contained in the laundry into a space between the drum and the tub, wherein the washing water discharged into the space is guided to the pump chamber to thereby be stored in the pump chamber, while the drum is rotating in one direction, or after the rotation of the drum in one direction is completed, operate the drain pump to discharge the washing water stored in the pump chamber, and after operating the drain pump to discharge the washing water, supply additional washing water that passes through the detergent supply device, to the tub, to perform the main washing of the laundry accommodated in the drum.

12. The washing machine according to claim 11, further comprising:

a dust sensor provided to sense an amount of dust, wherein the controller is configured to perform control to set at least one drum rotation factor of a rotational speed of the drum, an operation rate of the drum, and a rotational time of the drum, in the waterless process, based on the amount of dust sensed by the dust sensor.

13. The washing machine according to claim 11, wherein the controller is configured to perform control to, when rotating the drum in one direction, rotate the drum at a higher speed than when the drum is rotated to separate contaminants from the laundry in the waterless process.

14. A washing machine comprising:

a main body provided with an inlet at a front portion of the main body;

a door provided to open and close the inlet;

a tub having an opening corresponding to the inlet and provided inside the main body;

a drum, rotatably provided inside the tub, in which laundry received through the inlet is accomodatable;

a door cleaning nozzle aimed directly at the door to spray washing water toward the door;

a pump chamber provided at a lower portion of the tub to store washing water discharged from the tub;

a drain pump provided to pump washing water stored in the pump chamber to thereby be discharged to outside the washing machine;

a detergent supply device; and a controller configured to perform control to:

before main washing of laundry accommodated in the drum is performed, rotate the drum without water being in, or supplied to, the tub or the drum, to tumble the laundry accommodated in the drum, after the laundry has tumbled with the drum still rotating or after the rotation of the drum has stopped, and before the main washing of the laundry accommodated in the drum is performed, spray washing water by the door cleaning nozzle toward the door, wherein the sprayed washing water is discharged from the tub to the pump chamber to thereby be stored in the pump chamber, operate the drain pump to discharge the washing water stored in the pump chamber, and after operating the drain pump to discharge the washing water, supply additional washing water that passes through the detergent supply device, to the tub, to perform the main washing of the laundry accommodated in the drum.

15. The washing machine according to claim 14, further comprising:

a diaphragm provided to connect the inlet of the main body and the opening of the tub, wherein the controller is configured to, in order to clean the diaphragm while the washing water is being sprayed toward the door by the door cleaning nozzle, perform control to rotate the drum at a preset speed and spray washing water by the door cleaning nozzle for a preset time at a preset point.

16. The washing machine according to claim 15, further comprising:

a cleaning reinforcing nozzle provided on the diaphragm to spray washing water toward an inside of the drum, wherein the controller is configured to, before the main washing of the laundry accommodated in the drum is performed, perform control to spray the washing water through the cleaning reinforcing nozzle to clean the diaphragm of contaminants separated from the laundry by the waterless process.

17. The washing machine according to claim 15, further comprising:

a diaphragm cleaning nozzle provided at a position corresponding to a rotation direction of the drum on a buffer portion, which is a region where the diaphragm is bent, to spray washing water to the diaphragm, wherein the controller is configured to perform control to spray washing water by the diaphragm cleaning nozzle in the rotating direction of the drum when the washing water is sprayed by the door cleaning nozzle, to clean the diaphragm of contaminants separated from the laundry by the waterless process.

18. The washing machine according to claim 14, further comprising:

a water supply pipe provided to be connected to a rear upper side of the tub, wherein the controller is configured to perform control to supply washing water to the water supply pipe connected to the rear upper side of the tub to supply washing water to a rear surface of the tub before supplying the additional washing water that passes through the detergent supply device, to clean the rear surface of the tub of contaminants separated from the laundry by the waterless process.

19. A washing machine comprising:

a tub provided inside a main body;

a drum rotatably provided inside the tub and in which laundry is accommodatable;

at least one nozzle provided to spray washing water to an inside of the drum;

a pump chamber provided at a lower portion of the tub to store washing water discharged from the tub;

a drain pump provided to pump washing water stored in the pump chamber to thereby be discharged to outside the washing machine;

a detergent supply device; and a controller configured to perform control to:

before main washing of laundry accommodated in the drum is performed, rotate the drum without water being in, or supplied to, the tub or the drum, to tumble the laundry accommodated in the drum, after the laundry has tumbled with the drum still rotating or after the rotation of the drum has stopped, and before the main washing of the laundry accommodated in the drum is performed, spray washing water to the inside of the drum by the at least one nozzle to clean the inside of the drum, after spraying the washing water to the inside of the drum, rotate the drum in one direction to discharge washing water contained in the laundry into a space between the drum and the tub, wherein the washing water discharged into the space is guided to the pump chamber to thereby be stored in the pump chamber, while the drum is rotating in one direction, or after the rotation of the drum in one direction is completed, operate the drain pump to discharge the washing water stored in the pump chamber, and after operating the drain pump to discharge the washing water, supply additional washing water that passes through the detergent supply device, to the tub, to perform the main washing of the laundry accommodated in the drum.

* * * * *